US008650992B2

(12) United States Patent
Neitzell et al.

(10) Patent No.: US 8,650,992 B2
(45) Date of Patent: Feb. 18, 2014

(54) DRIVER ACCESSORY

(75) Inventors: Roger D. Neitzell, Palmyra, WI (US); Kaitlyn Beinlich, Milwaukee, WI (US); Ryan J. Malloy, Shorewood, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 328 days.

(21) Appl. No.: 13/028,736

(22) Filed: Feb. 16, 2011

(65) Prior Publication Data

US 2011/0197719 A1 Aug. 18, 2011

Related U.S. Application Data

(60) Provisional application No. 61/305,059, filed on Feb. 16, 2010.

(51) Int. Cl.
*B25B 23/16* (2006.01)

(52) U.S. Cl.
USPC ..... 81/177.75; 81/177.8; 81/177.85

(58) Field of Classification Search
USPC ..... 81/177.75, 177.8, 177.85
See application file for complete search history.

(56) References Cited

U.S. PATENT DOCUMENTS

| | | | |
|---|---|---|---|
| 61,581 | A | 1/1867 | Taylor |
| 76,819 | A | 4/1868 | Ross |
| 1,090,506 | A | 3/1914 | Sprague |
| 1,094,603 | A | 4/1914 | Scott |
| 1,398,116 | A | 11/1921 | Root |
| 1,431,208 | A | 10/1922 | Austin |
| 1,662,424 | A | 3/1928 | Judge |
| 1,924,089 | A | 8/1933 | Croessant |
| 2,114,807 | A | 11/1937 | McCavitt |
| 2,425,809 | A | 8/1947 | Johnson |
| 2,471,974 | A | 5/1949 | O'Malley |

(Continued)

FOREIGN PATENT DOCUMENTS

| | | |
|---|---|---|
| EP | 1466714 | 10/2004 |
| EP | 1775075 | 4/2007 |

(Continued)

OTHER PUBLICATIONS

PCT/US2011/025054 International Search Report dated Oct. 27, 2011 (5 pages).

(Continued)

*Primary Examiner* — Lee D Wilson
*Assistant Examiner* — Shantese McDonald
(74) *Attorney, Agent, or Firm* — Michael Best & Friedrich LLP

(57) ABSTRACT

A driver accessory includes a housing having a first housing portion and a second housing portion movable relative to the first housing portion, an input shaft at least partially received in the first housing portion and defining a first axis, and an output shaft at least partially received in the second housing portion and defining a second axis. The output shaft is supportable by the housing in a first position relative to the input shaft in which the first and second axes are substantially parallel, and in a second position relative to the input shaft in which the first and second axes are non-parallel. The driver accessory also includes a locking mechanism operable to secure the second housing portion relative to the first housing portion when the output shaft is in the first position and the second position relative to the input shaft.

19 Claims, 17 Drawing Sheets

(56) References Cited

U.S. PATENT DOCUMENTS

| | | | | |
|---|---|---|---|---|
| 2,526,105 | A | | 10/1950 | Adams |
| 2,687,025 | A | | 8/1954 | Wildhaber |
| 2,767,564 | A | | 10/1956 | Green |
| 2,854,829 | A | | 10/1958 | Porter |
| 3,232,075 | A | | 2/1966 | Wildhaber |
| 3,359,757 | A | | 12/1967 | Adams |
| 3,367,141 | A | | 2/1968 | Baughman et al. |
| 3,855,884 | A | | 12/1974 | McPeak |
| 3,897,703 | A | | 8/1975 | Phipps |
| 4,034,574 | A | | 7/1977 | Kuder |
| 4,065,941 | A | | 1/1978 | Aoki |
| 4,108,027 | A | | 8/1978 | Lenker |
| 4,114,401 | A | | 9/1978 | Van Hoose |
| 4,436,005 | A | | 3/1984 | Hanson |
| 4,464,141 | A | | 8/1984 | Brown |
| 4,824,418 | A | | 4/1989 | Taubert |
| 4,833,950 | A | | 5/1989 | Moncada |
| 4,938,731 | A | | 7/1990 | Nguyen et al. |
| 5,007,880 | A | | 4/1991 | Walker |
| 5,609,079 | A | | 3/1997 | Hashimoto |
| 5,738,586 | A | | 4/1998 | Arriaga |
| 5,802,934 | A | | 9/1998 | Harriot et al. |
| 5,918,512 | A | | 7/1999 | Habermehl et al. |
| 6,105,473 | A | | 8/2000 | Huang |
| 6,145,416 | A | * | 11/2000 | Bonniot ..... 81/177.75 |
| 6,152,826 | A | | 11/2000 | Profeta et al. |
| 6,290,606 | B1 | | 9/2001 | Hodson |
| 6,490,955 | B2 | | 12/2002 | Chang-Kao et al. |
| 6,575,062 | B2 | | 6/2003 | Hahn |
| 6,729,211 | B1 | | 5/2004 | Snow |
| 6,976,411 | B1 | | 12/2005 | Yu |
| 7,153,214 | B2 | | 12/2006 | Delaney et al. |
| 7,278,342 | B1 | * | 10/2007 | Chang ..... 81/177.75 |
| 2002/0083801 | A1 | * | 7/2002 | Cheng ..... 81/177.75 |
| 2002/0157506 | A1 | | 10/2002 | Schade |
| 2005/0119057 | A1 | | 6/2005 | Rom et al. |
| 2008/0012245 | A1 | | 1/2008 | Peters |

FOREIGN PATENT DOCUMENTS

| | | |
|---|---|---|
| JP | 08118247 | 5/1996 |
| JP | 09201777 | 8/1997 |
| JP | 3135810 | 9/2007 |
| WO | 2005070616 | 8/2008 |

OTHER PUBLICATIONS

PCT/US2011/025054 International Written Opinion dated Oct. 27, 2011 (3 pages).

* cited by examiner

DRIVER ACCESSORY

CROSS-REFERENCE TO RELATED APPLICATIONS

This application claims priority to U.S. Provisional Patent Application No. 61/305,059 filed on Feb. 16, 2010, the entire content of which is incorporated herein by reference.

FIELD OF THE INVENTION

The present invention relates to power tools, and more particularly to power tool accessories.

BACKGROUND OF THE INVENTION

Driver accessories are typically used to interconnect a tool bit to a chuck assembly of a powered drill. Such accessories typically include an input shaft having a hexagonal cross-sectional shape and a recess in which the tool bit is received. The recess includes a corresponding cross-sectional shape to that of the tool bit (e.g., a hexagonal shape). When using the drill and driver accessory in a relatively small area it is often difficult to maneuver the drill into an optimum position for driving a fastener into a workpiece using the tool bit and driver accessory.

SUMMARY OF THE INVENTION

The present invention provides, in one aspect, a driver accessory including a housing having a first housing portion and a second housing portion movable relative to the first housing portion, an input shaft at least partially received in the first housing portion and defining a first axis, and an output shaft at least partially received in the second housing portion and defining a second axis. The output shaft is supportable by the housing in a first position relative to the input shaft in which the first and second axes are substantially parallel, and in a second position relative to the input shaft in which the first and second axes are non-parallel. The driver accessory also includes a locking mechanism operable to secure the second housing portion relative to the first housing portion when the output shaft is in the first position and the second position relative to the input shaft.

The present invention provides, in another aspect, a driver accessory including a housing having a first housing portion and a second housing portion, an input shaft at least partially received in the first housing portion and defining a first axis, and an output shaft at least partially received in the second housing portion and defining a second axis. The second housing portion is rotatable about the second axis relative to the first housing portion to move the output shaft between a first position relative to the input shaft in which the first and second axes are substantially parallel, and a second position relative to the input shaft in which the first and second axes are non-parallel.

The present invention provides, in a further aspect, a driver accessory including an input shaft defining a first axis and configured to receive torque from a driver apparatus, an output shaft defining a second axis and configured to receive torque from the input shaft, and a housing supporting the output shaft in a first position relative to the input shaft, in which the first and second axes are substantially parallel, and in a second position relative to the input shaft, in which the first and second axes are non-parallel.

The housing includes a first housing portion in which the input shaft is at least partially received, and a second housing portion in which the output shaft is at least partially received. The second housing portion is movable relative to the first housing portion to move the output shaft between the first and second positions.

The driver accessory further includes a detent supported by one of the first and second housing portions, and a plurality of recesses defined on the other of the first and second housing portions. The detent is receivable in a first of the plurality of recesses to secure the output shaft in the first position. The detent is also receivable in a second of the plurality of recesses to secure the output shaft in the second position.

The driver accessory further includes an actuator movable between a release position in which the detent is positionable within either of the first and second recesses, and a locked position in which the detent is maintained within one of the first and second recesses.

The actuator is axially slidable relative to one of the first and second housing portions between the release position and the locked position.

The driver accessory further includes a biasing element engaged with the actuator to bias the actuator toward the locked position.

The driver accessory further includes an aperture in the one of the first and second housing portions in which the detent is supported. The detent is at least partially positioned within the aperture.

The driver accessory further includes a biasing element positioned within the aperture to bias the detent toward the other of the first housing portion and the second housing portion.

The aperture and the biasing element are coaxially aligned with a third axis. The third axis is oriented substantially parallel with one of the first axis and the second axis.

The first and second recesses are defined in the second housing portion. The aperture is defined in the first housing portion.

The driver accessory further includes a bearing positioned between the input shaft and the first housing portion.

The driver accessory further includes a bearing positioned between the output shaft and the second housing portion.

The second housing portion pivots relative to the first housing portion to move the output shaft between the first and second positions.

The driver accessory further includes a joint coupling the input shaft and the output shaft.

The joint may be configured as a universal joint including a pin carried by the output shaft and a socket formed in the input shaft in which the pin is received. The socket is configured to permit pivoting of the output shaft relative to the input shaft about respective orthogonal axes, each of which is oriented substantially normal to the first axis.

The joint may be configured as a ball-and-socket joint including a ball carried by one of the input shaft and the output shaft and a socket formed in the other of the input shaft and the output shaft in which the ball is received. The socket is configured to permit pivoting of the output shaft relative to the input shaft about respective orthogonal axes, each of which is oriented substantially normal to the first axis.

The ball includes a hexagonal cross-sectional shape. The socket includes a corresponding hexagonal cross-sectional shape.

The input shaft includes a shank having a hexagonal cross-sectional shape configured to be received within a chuck of the driver apparatus. The output shaft includes a socket having a hexagonal cross-sectional shape configured to receive a tool bit having a hexagonal drive end.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
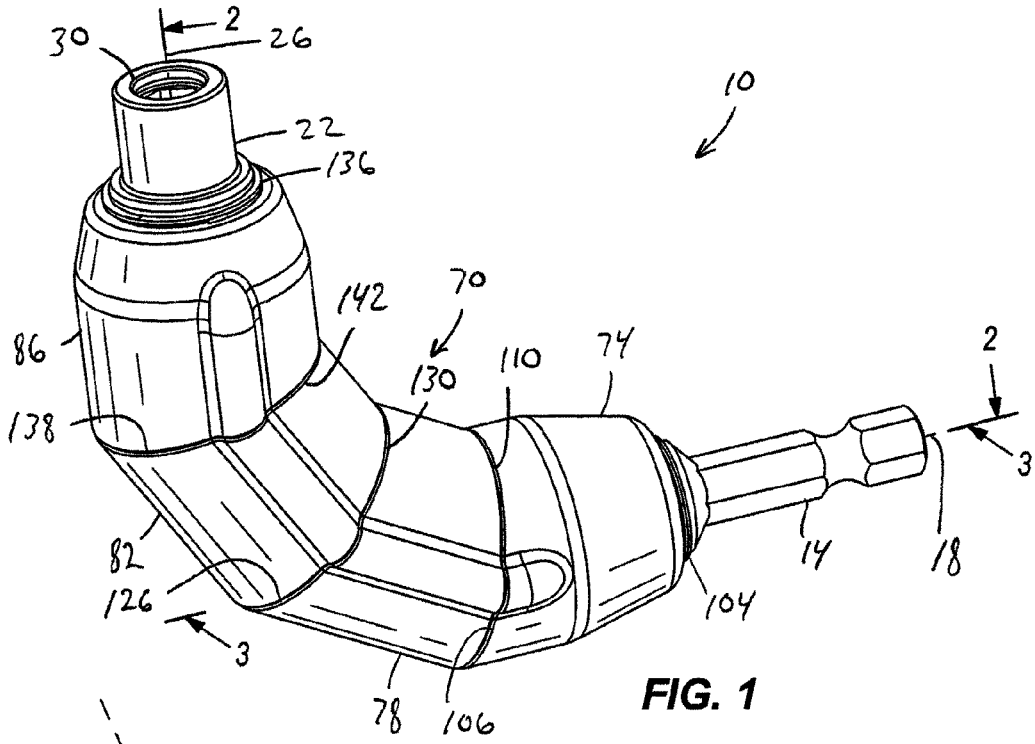
FIG. 1 is a perspective view of a driver accessory according to a first embodiment of the invention, illustrating an output shaft of the driver accessory in a first orientation with respect to an input shaft.
Figure 2:
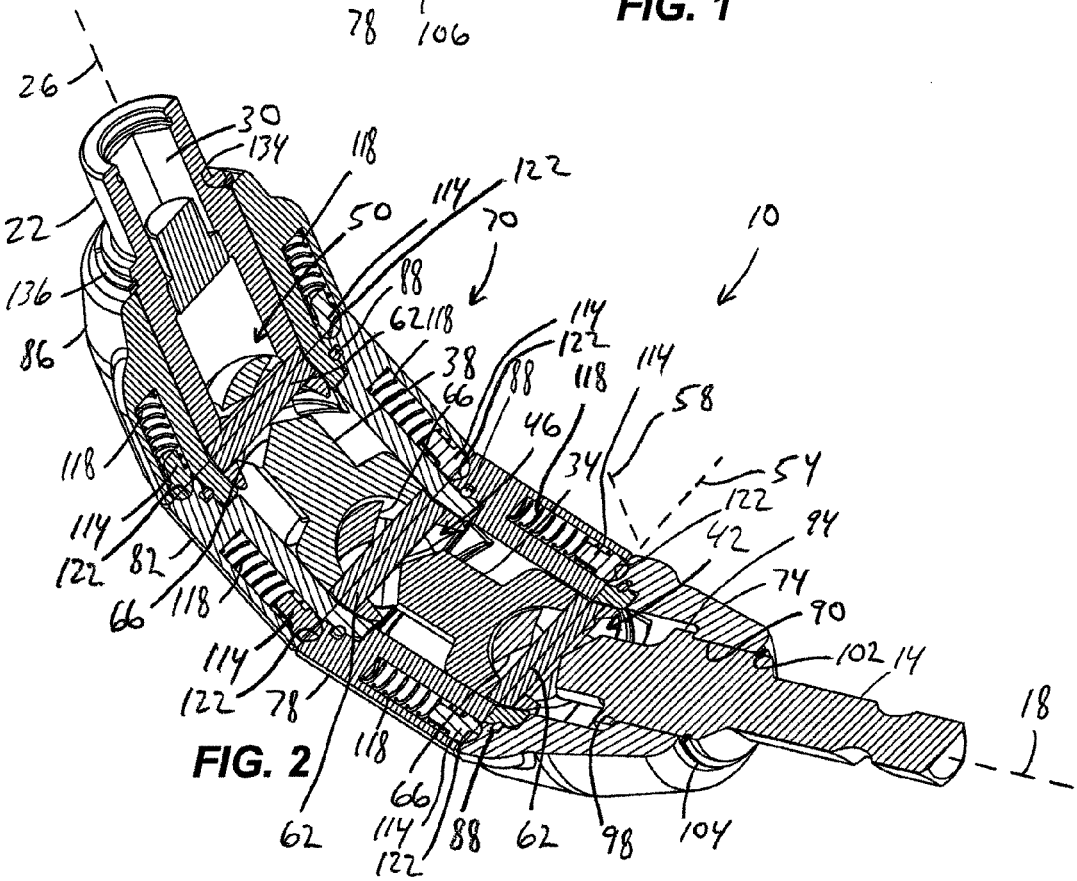
FIG. 2 is a perspective, cross-sectional view of the driver accessory of FIG. 1 taken along line 2-2 in FIG. 1.
Figure 3:
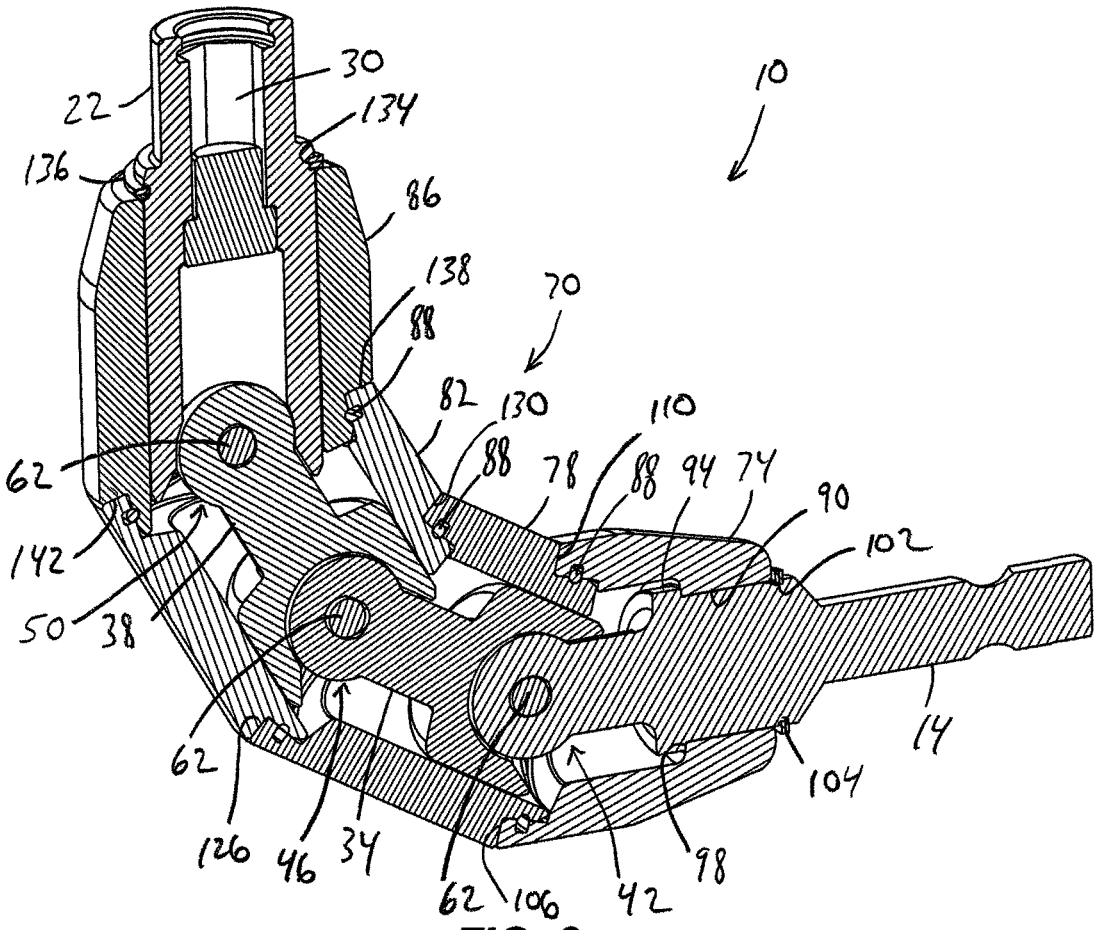
FIG. 3 is a cross-sectional view of the driver accessory of FIG. 1 taken along line 3-3 in FIG. 1.

FIGS. 1-3 illustrate a driver accessory 10 according to one embodiment of the invention. The driver accessory 10 includes an input shaft 14, defining a longitudinal axis 18 (FIG. 1), configured to receive torque from a driver (e.g., a drill, a hand driver, etc.). In the illustrated construction of the driver accessory 10, the input shaft 14 includes a hexagonal cross-sectional shape for engagement with a chunk of a drill or a hexagonal socket in a hand driver. Alternatively, the input shaft 14 may include any of a number of different shapes according to the particular configuration of the drill chuck and/or socket in the hand driver. The driver accessory 10 also includes an output shaft 22, defining a longitudinal axis 26, drivably coupled to the input shaft 14 to receive torque from the input shaft 14. In the illustrated construction of the driver accessory 10, the output shaft 22 includes a socket 30 having a hexagonal cross-sectional shape configured to receive a tool bit having a hexagonal drive end. Alternatively, the socket 30 may be configured having any of a number of different cross-sectional shapes corresponding to the particular drive end configuration of the tool bit (e.g., a square bit, a star bit, etc.). As a further alternative, the output shaft 22 may include a head, having any of a number of different cross-sectional shapes, configured to be received within a tool socket having a corresponding shape.

With reference to FIG. 2, the driver accessory 10 includes two intermediate shafts 34, 38 interconnecting the input shaft 14 and the output shaft 22, and three joints 42, 46, 50 configured to permit the output shaft 22 and the intermediate shafts 34, 38 to articulate relative to each other and the input shaft 14. As a result, the output shaft 22 can be reoriented with respect to the input shaft 14 to increase the maneuverability of a drill or a hand driver when working in a tight or confined workspace. FIGS. 1-3 illustrate the output shaft 22 positioned with respect to the input shaft 14 such that the respective axes 26, 18 of the output shaft 22 and the input shaft 14 are substantially normal. Alternatively, the driver accessory 10 may be configured to position the respective axes 26, 18 of the output shaft 22 and the input shaft 14 such that they are substantially parallel (FIGS. 16 and 17) or coaxial (FIGS. 12 and 13) with each other, or such that the axes 26, 18 are inclined with respect to each other at an oblique included angle (FIGS. 8-11, 14, and 15).

Figure 4:
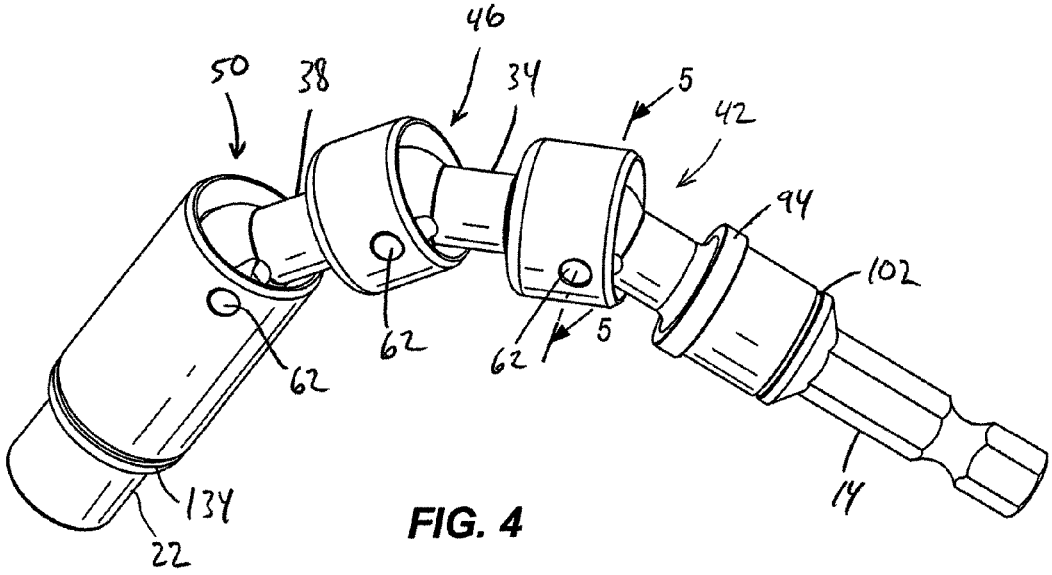
FIG. 4 is a perspective view of the input shaft, the output shaft, and two intermediate shafts of the driver accessory of FIG. 1 interconnected by respective universal joints.
Figure 5:
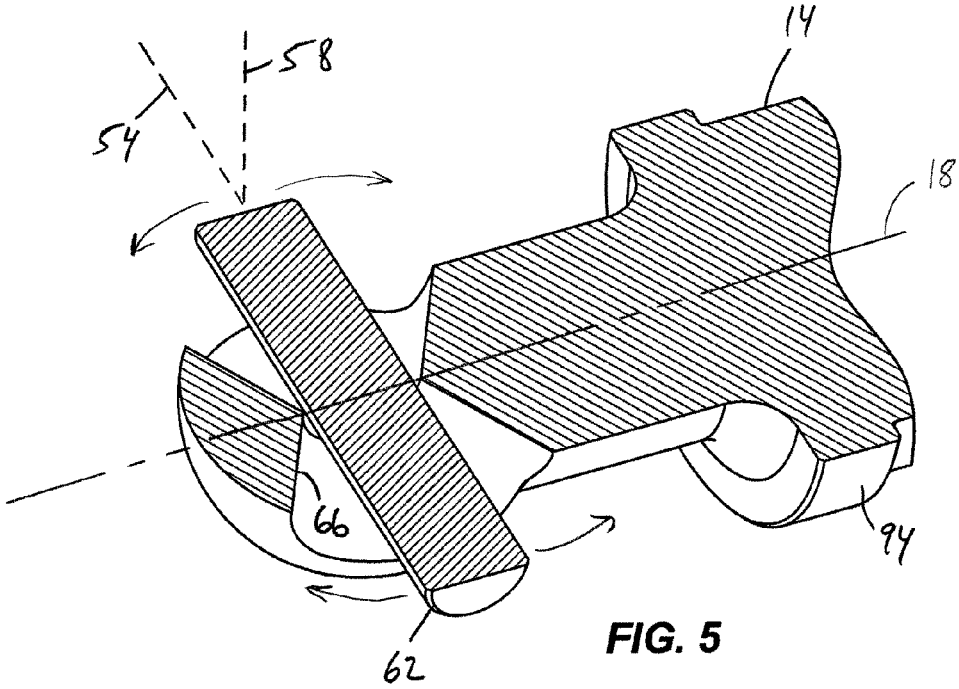
FIG. 5 is an enlarged, cross-sectional view through one of the universal joints of FIG. 4 taken along line 5-5 in FIG. 4.

With reference to FIGS. 2, 4, and 5, the first joint 42 is a universal joint configured to permit pivoting of the first intermediate shaft 34 relative to the longitudinal axis 18 of the input shaft 14. Particularly, the first joint 42 includes a pin 62 carried by the first intermediate shaft 34 and a socket 66 formed in the input shaft 14 in which the pin 62 is received. The socket 66 includes a diverging conical shape on each side of the longitudinal axis 18 such that the pin 62 is allowed to pivot within the socket 66 along the axis 18 with the position of the center of the pin being substantially fixed, as is best illustrated in FIG. 5. As a result, the first joint 42 permits the first intermediate shaft 34 to rotate about a longitudinal axis that is non-collinear with the longitudinal axis 18 of the input shaft 14.

The second joint 46 is also a universal joint configured to permit pivoting of the second intermediate shaft 38 relative to the first intermediate shaft 34 about respective orthogonal axes (not shown), each of which is oriented substantially normal to a longitudinal axis of the first intermediate shaft 34. Further, the third joint 50 is a universal joint configured to permit pivoting of the output shaft 22 relative to the second intermediate shaft 28 about respective orthogonal axes (not shown), each of which is oriented substantially normal to a longitudinal axis of the second intermediate shaft 38. Like components are labeled with like reference numerals. Although the illustrated construction of the driver accessory 10 includes two intermediate shafts 34, 38 between the input and output shafts 14, 22, the driver accessory 10 may include any of a number of different intermediate shafts to permit a more fine or coarse angular adjustment of the orientation of the output shaft 22 relative to the input shaft 14.

Figure 6:
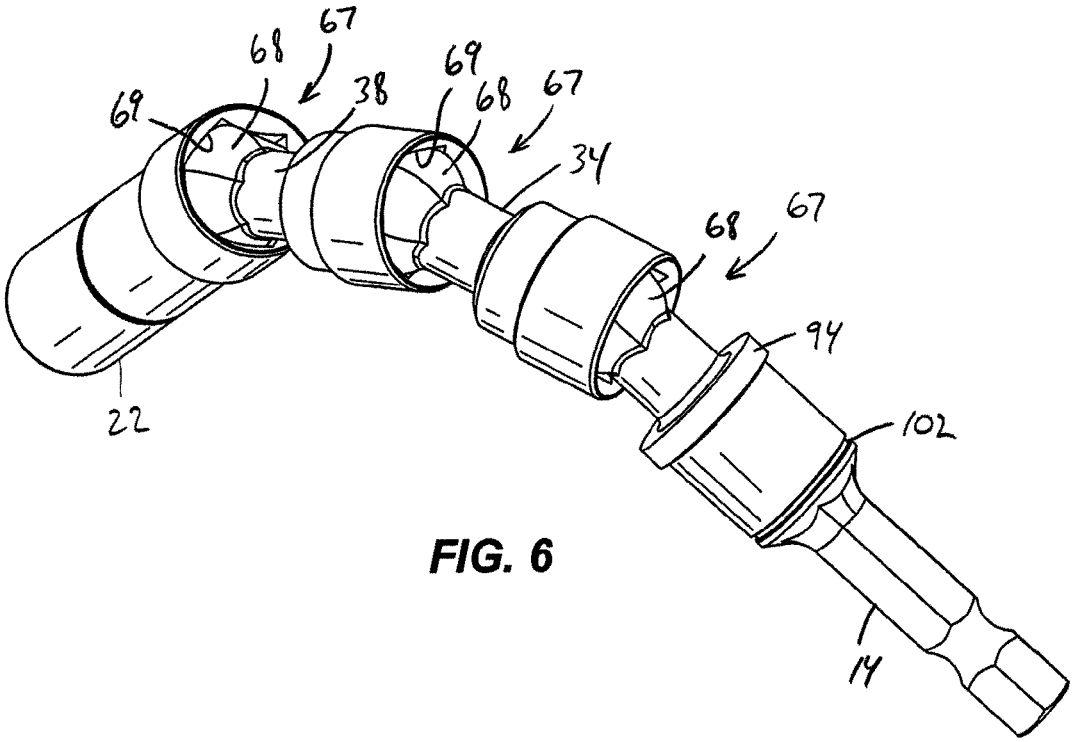
FIG. 6 is a perspective view of the input shaft, the output shaft, and two intermediate shafts of the driver accessory of FIG. 1 interconnected by respective ball-and-socket joints.
Figure 7:
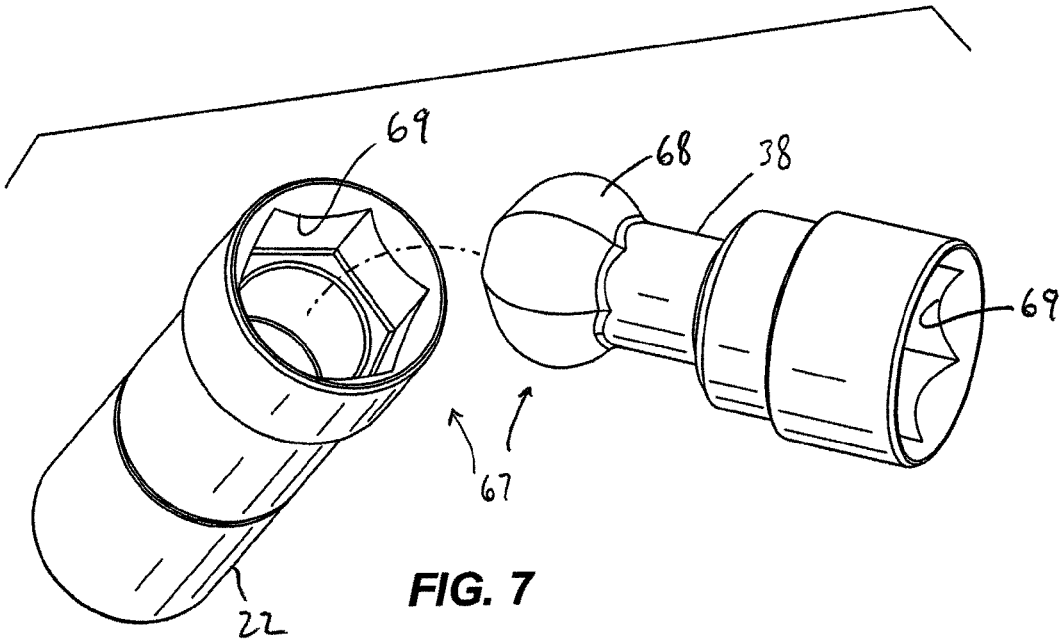
FIG. 7 is an enlarged, exploded perspective view of one of the ball-and-socket joints of FIG. 7.

With reference to FIGS. 6 and 7, the first, second, and third universal joints 42, 46, 50 may alternatively be configured as ball-and-socket joints 67. Each of the ball-and-socket joints 67 includes a head or ball 68 having a substantially hexagonal cross-sectional shape and a hexagonal socket 69 in which the ball 68 is at least partially received. Alternatively, the ball 68 and socket 69 may each include a different cross-sectional shape other than a hexagonal cross-sectional shape to facilitate torque transfer through the joint 67. The ball-and-socket joints 67 would permit the driver accessory 10 to function in a similar manner as described above when using the universal joints 42, 46, 50 and could eliminate the need for the pin 62.

With reference to FIGS. 1-3, the driver accessory 10 also includes a housing 70 in which the input shaft 14 and the output shaft 22 are at least partially received and supported. The housing 70 includes four portions 74, 78, 82, 86, each of which is pivotable with respect to an adjacent housing portion and interconnected to an adjacent housing portion by a retaining ring 88, to support the output shaft 22 in a particular orientation or position relative to the input shaft 14. The first housing portion 74 includes an aperture 90 in which the input shaft 14 is received and supported for rotation (FIGS. 2 and 3). The input shaft 14 includes a lip 94 engageable with an interior face 98 of the first housing portion 74 to inhibit axial movement of the input shaft 14 relative to the first housing portion 74 in a first direction. The input shaft 14 also includes a circumferential groove 102 in the outer periphery of the input shaft 14 in which a retaining ring 104 is received to inhibit axial movement of the input shaft 14 relative to the first housing portion 74 in an opposite, second direction. Although not shown, a bearing or a bushing may be utilized between the first housing portion 74 and the input shaft 14 to reduce friction between the first housing portion 74 and the input shaft 14.

The first intermediate shaft 34 is supported within the second housing portion 78 for rotation about the longitudinal axis of the first intermediate shaft 34. Although not shown, a bearing or a bushing may be utilized between the second housing portion 78 and the first intermediate shaft 34 to reduce friction between the second housing portion 78 and the first intermediate shaft 34.

With reference to FIGS. 1 and 3, the first housing portion 74 includes an inclined cam surface 106 on an open end of the first housing portion 74, and the second housing portion 78 includes an inclined cam surface 110 on an open, first end of the second housing portion 78 that is engaged and in facing relationship with the cam surface 106 of the first housing portion 74. The cam surfaces 106, 110 are defined by a common plane oriented obliquely to the longitudinal axis 18. In the illustrated construction of the driver accessory 10, each of the cam surfaces 106, 110 and the common plane are inclined with respect to a reference plane that is normal to the longitudinal axis 18 of the input shaft 14 by about 15 degrees. As such, the second housing portion 78 is rotatable about the longitudinal axis 18 of the input shaft 14 between a first rotational position, in which the directions of the inclined cam surfaces 106, 110 cancel each other thereby positioning the first intermediate shaft 34 coaxial with the input shaft 14, and a second rotational position, in which the directions of the inclined cam surfaces 106, 110 are cumulative thereby inclining the first intermediate shaft 34 by about 30 degrees with respect to the input shaft 14. Alternatively, the respective cam surfaces 106, 110 on the first and second housing portions 74, 78 may be inclined more or less than about 15 degrees.

With reference to FIG. 2, the driver accessory 10 includes a locking mechanism configured as two detents 114 received within the second housing portion 78 and biased by respective springs 118, and a corresponding number (i.e., two) of recesses 122 formed in the cam surface 106 of the first housing portion 74. In the illustrated construction of the driver accessory 10, the detents 114 and recesses 122 secure the second housing portion 78 in the first and second rotational positions mentioned above. Accordingly, when switching between the first and second rotational positions, each of the detents 114 is moved out of its current recess 122 and into the other recess 122. Alternatively, other structure and/or components may be employed to provide a positive stop between the first and second housing portions 74, 78 when rotating the second housing portion 78 relative to the first housing portion 74. Further, the detents 114 may be received within the first housing portion 74, and the recesses 122 may be formed in the cam surface 110 of the second housing portion 78. As a further alternative, an additional pair of recesses may be formed in the cam surface 106 of the first housing portion 74 ninety degrees out of phase with the illustrated recesses 122 to secure the second housing portion 78 relative to the first housing portion 74, when the second housing portion 78 is rotated to a position half-way between the first and second rotational positions mentioned above, such that the first intermediate shaft 34 is inclined by about 15 degrees with respect to the input shaft 14.

The second intermediate shaft 38 is supported within the third housing portion 82 for rotation about the longitudinal axis of the second intermediate shaft 38. Although not shown, a bearing or a bushing may be utilized between the third housing portion 82 and the second intermediate shaft 38 to reduce friction between the third housing portion 82 and the second intermediate shaft 38.

With reference to FIGS. 1 and 3, the second housing portion 78 includes an inclined cam surface 126 on an open, second end of the second housing portion 78, and the third housing portion 82 includes an inclined cam surface 130 on an open, first end of the third housing portion 82 that is engaged and in facing relationship with the cam surface 126 of the second housing portion 78. The cam surfaces 126, 130 are defined by a common plane oriented obliquely to the longitudinal axis of the first intermediate shaft 34. In the illustrated construction of the driver accessory 10, each of the cam surfaces 126, 130 and the common plane are inclined with respect to a reference plane that is normal to the longitudinal axis of the first intermediate shaft 34 by about 15 degrees. As such, the third housing portion 82 is rotatable about the longitudinal axis of the first intermediate shaft 34 between a first rotational position, in which the directions of the inclined cam surfaces 126, 130 cancel each other thereby positioning the second intermediate shaft 38 coaxial with the first intermediate shaft 34, and a second rotational position, in which the directions of the inclined cam surfaces 126, 130 are cumulative thereby inclining the second intermediate shaft 38 by about 30 degrees with respect to the first intermediate shaft 34. When both the second and third housing portions 78, 82 are rotated to their second rotational positions, the longitudinal axis of the second intermediate shaft 38 is inclined relative to the longitudinal axis of the input shaft 14 by about 60 degrees, with 30 degrees of incline occurring between the first and second housing portions 74, 78, and an additional 30 degrees of incline occurring between the second and third housing portions 78, 82. Alternatively, the respective cam surfaces 126, 130 on the second and third housing portions 78, 82 may be inclined more or less than about 15 degrees.

Additional detents 114 are positioned between the second and third housing portions 78, 82, and a corresponding number of recesses 122 are formed in the cam surface 126 of the second housing portion 78. Like components are labeled with like reference numerals. As an alternative, an additional pair of recesses may be formed in the cam surface 126 of the second housing portion 78 ninety degrees out of phase with the illustrated recesses 122 to secure the third housing portion 82 relative to the second housing portion 78, when the third housing portion 82 is rotated to a position half-way between the first and second rotational positions mentioned above, such that the second intermediate shaft 38 is inclined by about 15 degrees with respect to the first intermediate shaft 34.

The output shaft 22 is supported within the fourth housing portion 86 for rotation about the longitudinal axis 26 of the output shaft 22. The output shaft 22 includes a circumferential groove 134 in the outer periphery of the output shaft 22 in which a retaining ring 136 is receivable to inhibit axial movement of the output shaft 22 into the fourth housing portion 86. The output shaft 22 is inhibited from moving axially out of the fourth housing portion 86 by the retaining ring in the groove 102 of the input shaft 14 and the intermediate shafts 34, 38 interconnecting the output shaft 22 and the input shaft 14. Although not shown, a bearing or a bushing may be utilized between the third housing portion 82 and the second intermediate 38 shaft to reduce friction between the third housing portion 82 and the second intermediate shaft 38. Also, a bearing or a bushing may be utilized between the fourth housing portion 86 and the output shaft 22 to reduce friction between the fourth housing portion 86 and the output shaft 22.

With reference to FIGS. 1 and 3, the third housing portion 82 includes an inclined cam surface 138 on an open, second end of the third housing portion 82, and the fourth housing portion 86 includes an inclined cam surface 142 on an open, first end of the fourth housing portion 86 that is engaged and in facing relationship with the cam surface 138 of the third housing portion 82. The cam surfaces 138, 142 are defined by a common plane oriented obliquely to the longitudinal axis of the second intermediate shaft 38. In the illustrated construction of the driver accessory 10, each of the cam surfaces 138, 142 and the common plane are inclined with respect to a reference plane that is normal to the longitudinal axis of the second intermediate shaft 38 by about 15 degrees. As such, the fourth housing portion 86 is rotatable about the longitudinal axis of the second intermediate shaft 38 between a first rotational position, in which the directions of the inclined cam surfaces 138, 142 cancel each other thereby positioning the output shaft 22 coaxial with the second intermediate shaft 38, and a second rotational position, in which the directions of the inclined cam surfaces 138, 142 are cumulative thereby inclining the output shaft 22 by about 30 degrees with respect to the second intermediate shaft 38.

When both the second, third, and fourth housing portions 78, 82, 86 are rotated to their second rotational positions, the longitudinal axis 26 of the output shaft 22 is inclined relative to the longitudinal axis 18 of the input shaft 14 by about 90 degrees, with 30 degrees of incline occurring between the first and second housing portions 74, 78, an additional 30 degrees of incline occurring between the second and third housing portions 82, 86, and an additional 30 degrees of incline occurring between the third and fourth housing portions. Alternatively, the respective cam surfaces 138, 142 on the third and fourth housing portions 82, 86 may be inclined more or less than about 15 degrees.

Additional detents 114 are positioned between the third and fourth housing portions 82, 86, and a corresponding number of recesses 122 are formed in the cam surface 138 of the third housing portion 82. Like components are labeled with like reference numerals. As an alternative, an additional pair of recesses may be formed in the cam surface 138 of the third housing portion 82 ninety degrees out of phase with the illustrated recesses 122 to secure the fourth housing portion 86 relative to the third housing portion 82, when the fourth housing portion 86 is rotated to a position half-way between the first and second rotational positions mentioned above, such that the output shaft 22 is inclined by about 15 degrees with respect to the second intermediate shaft 38.

Figure 12:
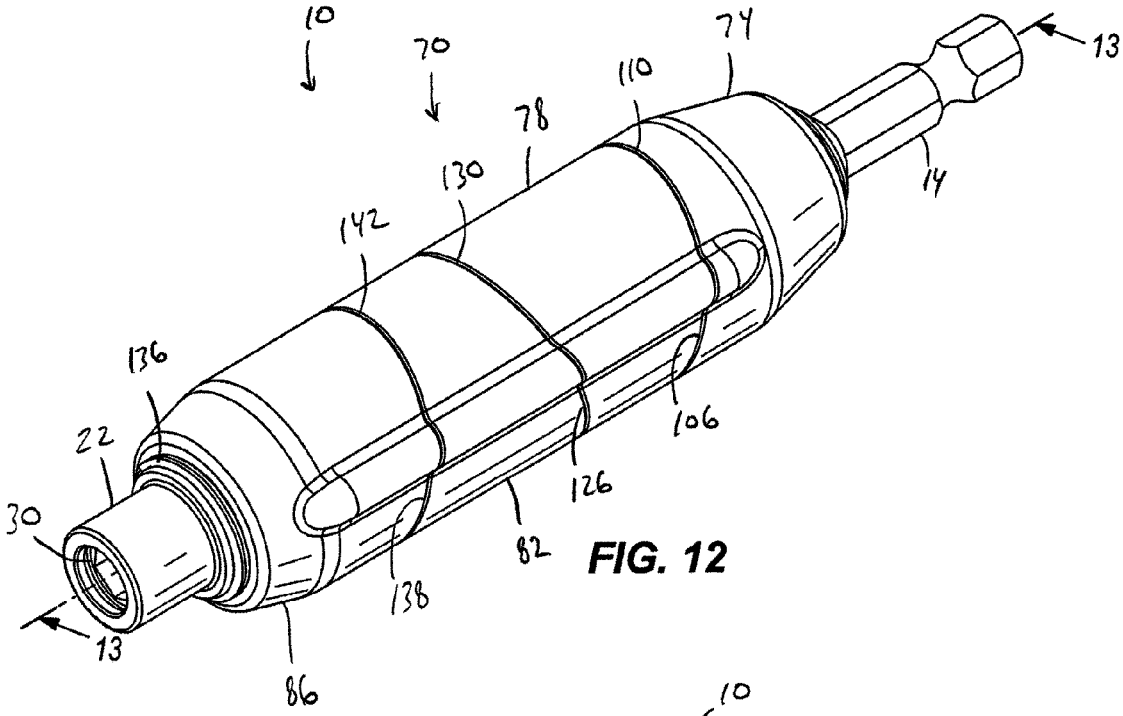
FIG. 12 is a perspective view of the driver accessory of FIG. 1, illustrating the output shaft in a fourth orientation with respect to the input shaft.
Figure 13:
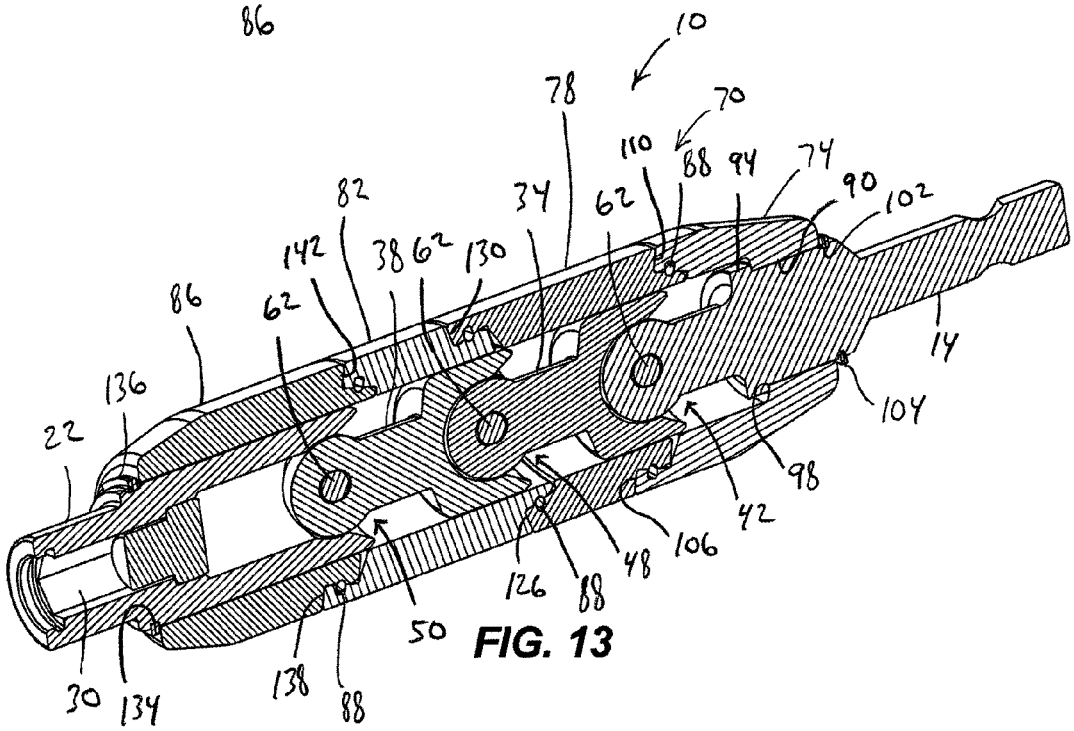
FIG. 13 is a cross-sectional view of the driver accessory of FIG. 12 taken along line 13-13 in FIG. 12.
Figure 14:
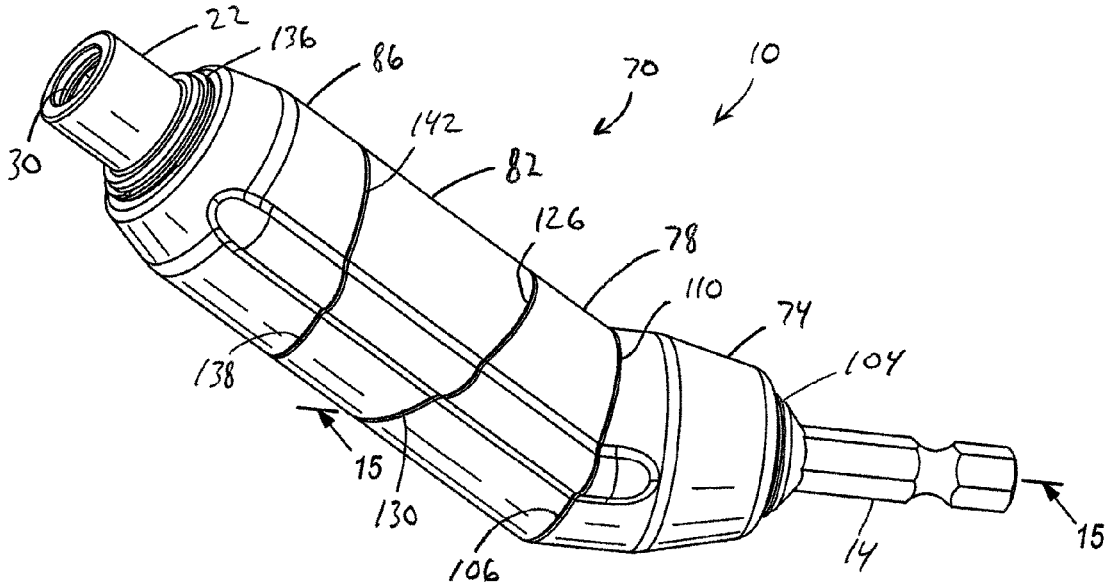
FIG. 14 is a perspective view of the driver accessory of FIG. 1, illustrating the output shaft in a fifth orientation with respect to the input shaft.
Figure 15:
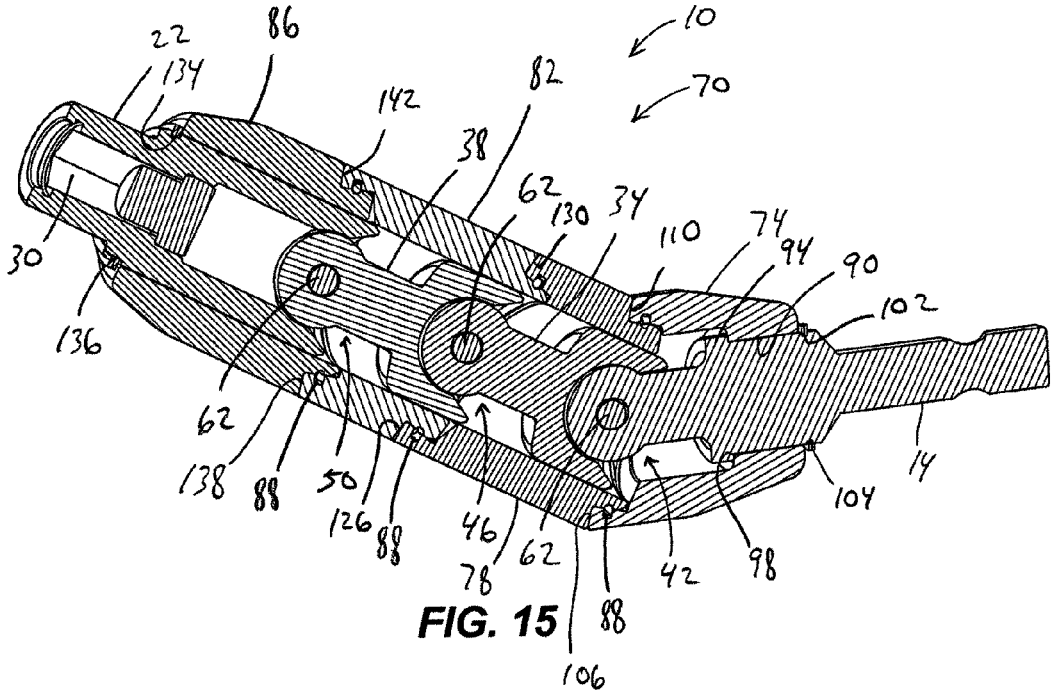
FIG. 15 is a cross-sectional view of the driver accessory of FIG. 14 taken along line 15-15 in FIG. 14.

In operation of the driver accessory 10, the input shaft 14 is secured to a chuck of a drill, or a socket of a hand driver, and a tool bit is inserted within the socket 30 in the output shaft 22. The second, third, and fourth housing portions 78, 82, 86 are then each rotated between the first and second rotational positions to orient the output shaft 22 at a desired angle or position with respect to the input shaft 14. For example, to orient the output shaft 22 at a substantially 90-degree angle with respect to the input shaft 14, each of the second, third, and fourth housing portions 78, 82, 86 is rotated to its second rotational position (FIGS. 1-3). Likewise, to orient the output shaft 22 substantially coaxial with the input shaft 14, each of the second, third, and fourth housing portions 78, 82, 86 is rotated to its first rotational position (FIGS. 12 and 13).

Figure 8:
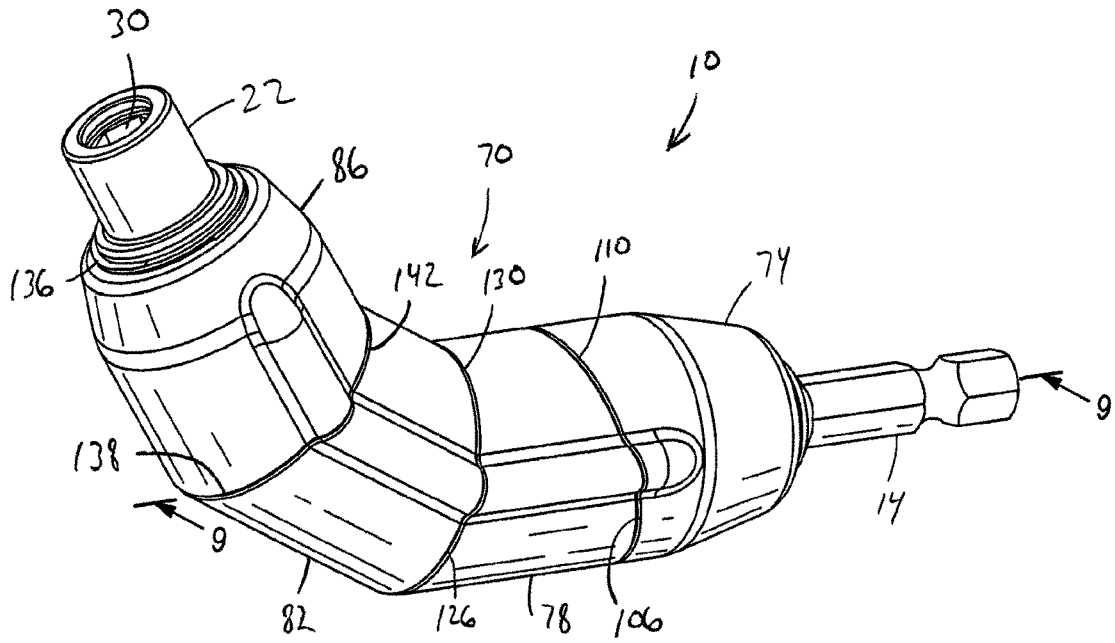
FIG. 8 is a perspective view of the driver accessory of FIG. 1, illustrating the output shaft in a second orientation with respect to the input shaft.
Figure 9:
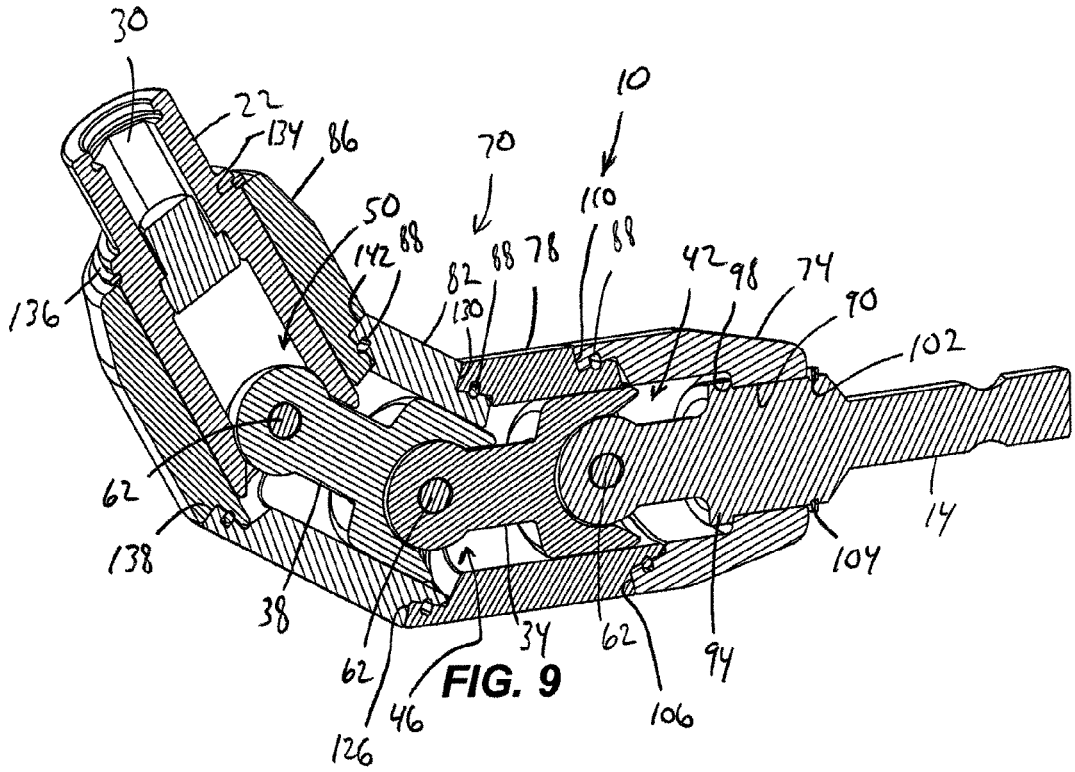
FIG. 9 is a cross-sectional view of the driver accessory of FIG. 8 taken along line 9-9 in FIG. 8.

To orient the output shaft 22 at a substantially 60-degree angle with respect to the input shaft 14, the second housing portion 78 is rotated to its first rotational position with respect to the first housing portion 74, the third housing portion 82 is rotated to its second rotational position with respect to the second housing portion 78, and the fourth housing portion 86 is rotated to its second rotational position with respect to the third housing portion 82 (see, for example, the driver accessory 10 in FIGS. 8 and 9). Alternatively, the second housing portion 78 may be rotated to its second rotational position with respect to the first housing portion 74, the third housing portion 82 may be rotated to its second rotational position with respect to the second housing portion 78, and the fourth housing portion 86 may be rotated to its first rotational position with respect to the third housing portion 82.

Figure 10:
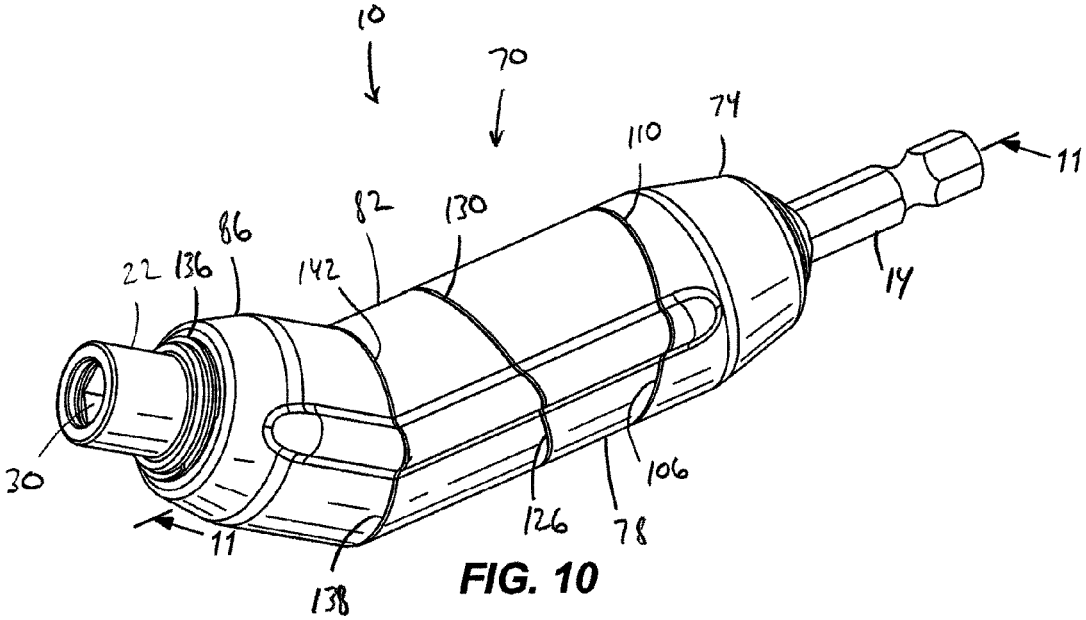
FIG. 10 is a perspective view of the driver accessory of FIG. 1, illustrating the output shaft in a third orientation with respect to the input shaft.
Figure 11:
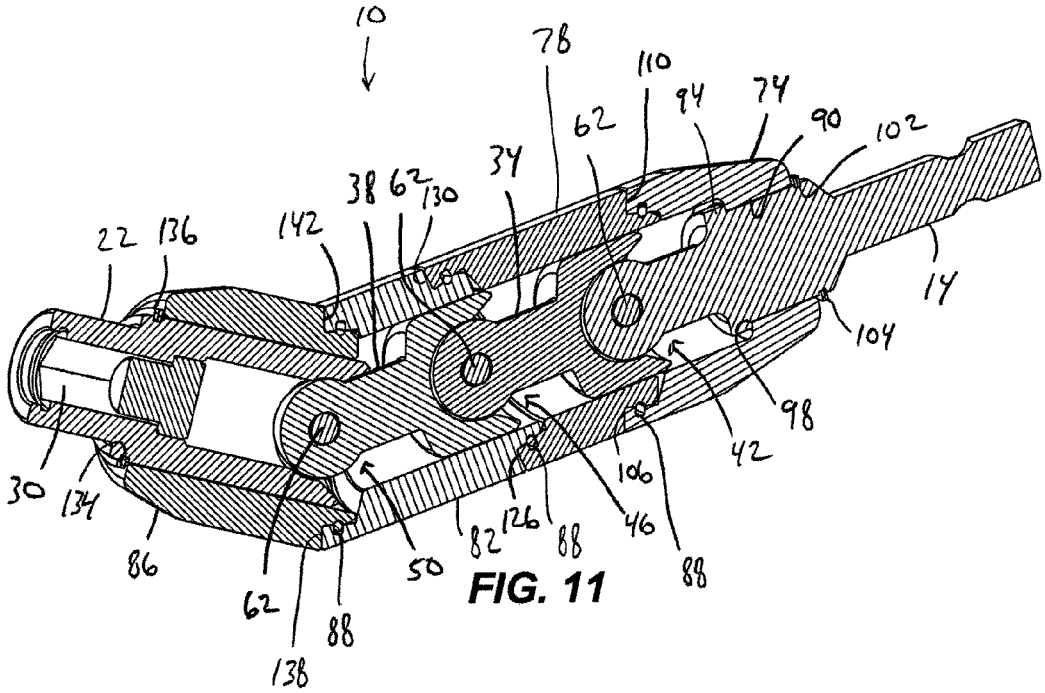
FIG. 11 is a cross-sectional view of the driver accessory of FIG. 10 taken along line 11-11 in FIG. 10.

To orient the output shaft 22 at a substantially 30-degree angle with respect to the input shaft 14, the second housing portion 78 is rotated to its first rotational position with respect to the first housing portion 74, the third housing portion 82 is rotated to its first rotational position with respect to the second housing portion 78, and the fourth housing portion 86 is rotated to its second rotational position with respect to the third housing portion 82 (see, for example, the driver accessory 10 in FIGS. 10 and 11). Alternatively, the second housing portion 78 may be rotated to its second rotational position with respect to the first housing portion 74, the third housing portion 82 may be rotated to its first rotational position with respect to the second housing portion 78, and the fourth housing portion 86 may be rotated to its first rotational position with respect to the third housing portion 82 (see, for example, the driver accessory 10 in FIGS. 14 and 15). As a further alternative, the second housing portion 78 may be rotated to its first rotational position with respect to the first housing portion 74, the third housing portion 82 may be rotated to its second rotational position with respect to the second housing portion 78, and the fourth housing portion 86 may be rotated to its first rotational position with respect to the third housing portion 82.

Figure 16:
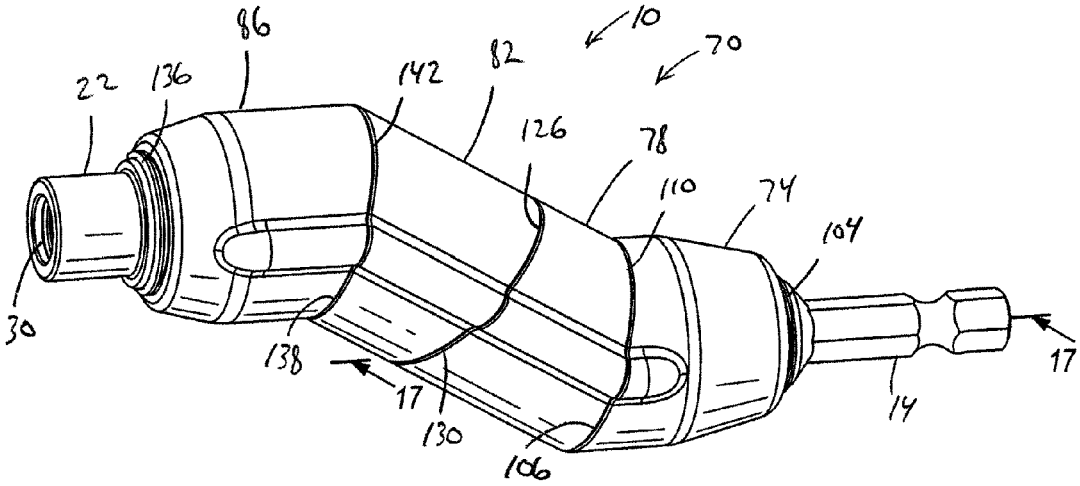
FIG. 16 is a perspective view of the driver accessory of FIG. 1, illustrating the output shaft in a sixth orientation with respect to the input shaft.
Figure 17:
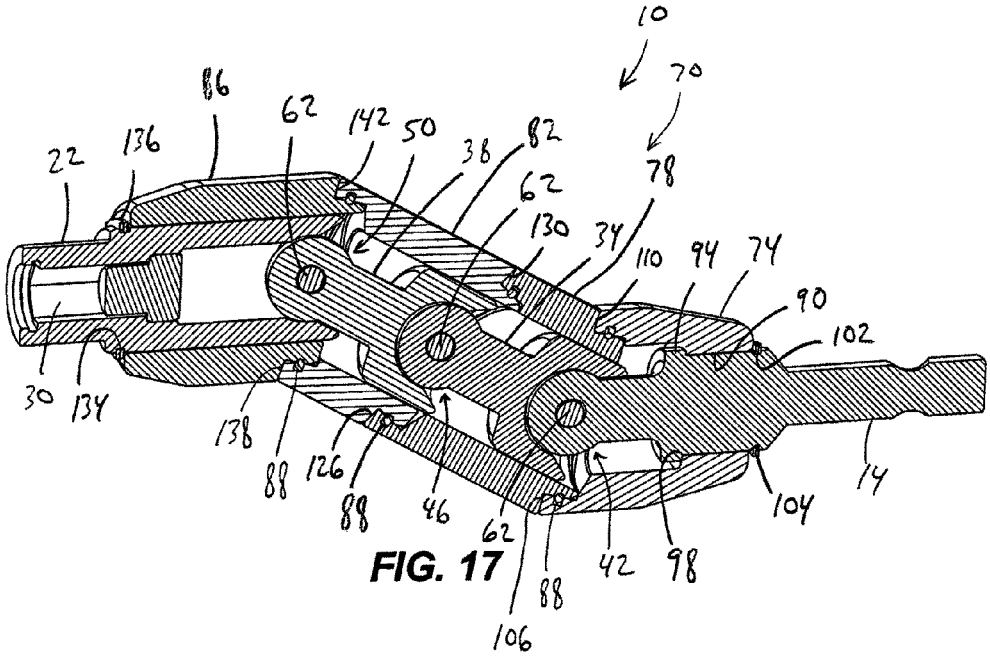
FIG. 17 is a cross-sectional view of the driver accessory of FIG. 16 taken along line 17-17 in FIG. 16.

To position the output shaft 22 substantially parallel to and offset from the input shaft 14, the second housing portion 78 is rotated to its second rotational position with respect to the first housing portion 74, the third housing portion 82 is rotated to its first rotational position with respect to the second housing portion 78, and the fourth housing portion 86 is rotated to its second rotational position with respect to the third housing portion 82 (see, for example, the driver accessory 10 in FIGS. 16 and 17).

The housing 70 supports the output shaft 22 relative to the input shaft 14 as torque from the input shaft 14 is transferred to the output shaft 22 via the intermediate shafts 34, 38 and the joints 42, 46, 50, without any additional assistance from the operator of the drill and/or hand driver. As such, the operator may use their free hand to maintain the alignment of the fastener being driven into the workpiece during the initial period of insertion of the fastener into the workpiece.

Figure 18:
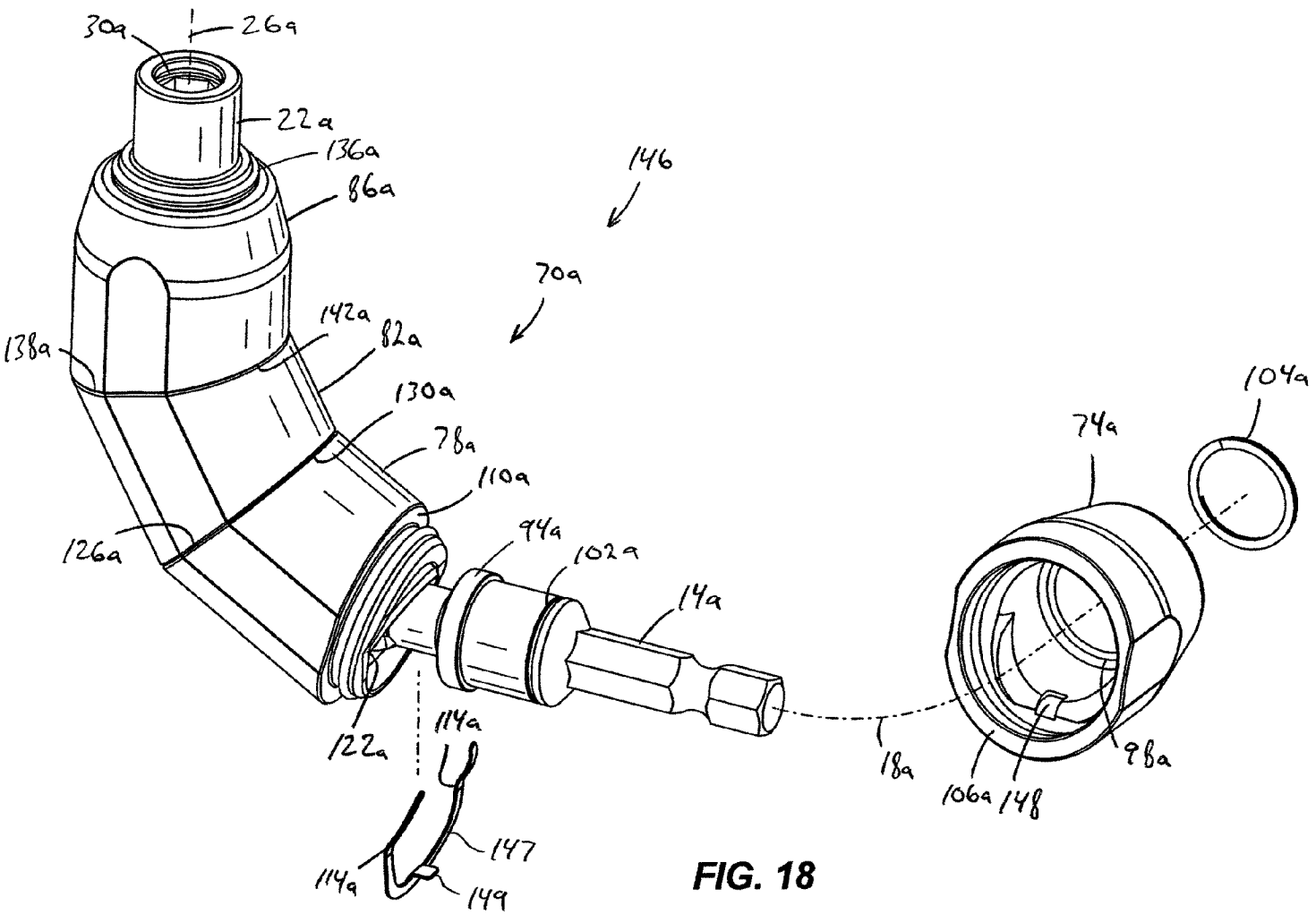
FIG. 18 is a perspective, partially exploded view of a driver accessory according to a second embodiment of the invention.

FIG. 18 illustrates a driver accessory 146 according to a second embodiment of the invention, with like components being labeled with like reference numerals with the letter "a." Rather than incorporating spring-biased ball detents 114 like the driver accessory 10 of FIGS. 1-3 and 7-17, the driver accessory 146 includes a resiliently deflectable spring clip 147 positioned between the adjacent housing portions 74*a*, 78*a*, 82*a*, 86*a*. With reference to FIG. 18, the first housing portion 74*a* includes a recess 148 in which a portion of the clip 147 (e.g., a tab 149) is received such that the clip 147 is rotationally fixed to the first housing portion 74*a*. The clip 147 includes a locking mechanism configured as opposed detents 114*a* that are received within respective recesses 122*a* in the second housing portion 78*a* when the second housing portion 78*a* is in its first and second rotational positions with respect to the first housing portion 74*a*. Additional clips 147 are positioned between the adjacent housing portions 78*a*, 82*a*, 86*a* in the same manner. The operation of the driver accessory 146 of FIG. 18 is identical to the driver accessory 10 of FIGS. 1-3 and 7-17, and will not be described again in detail.

Figure 19:
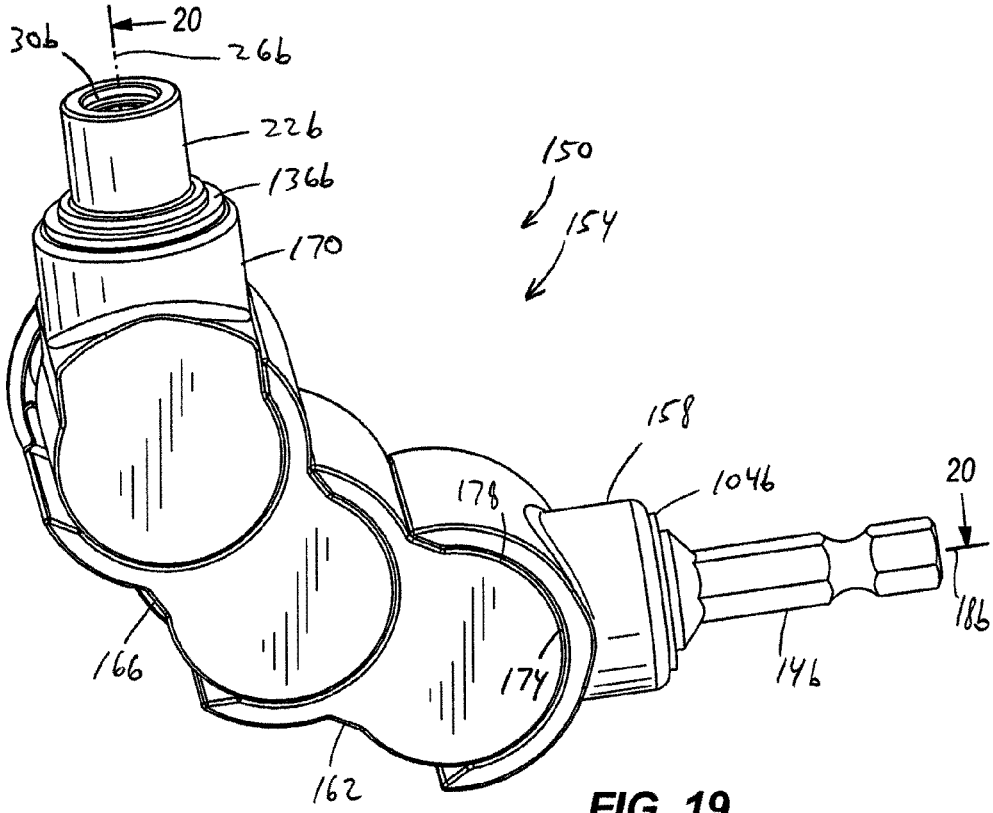
FIG. 19 is a perspective view of a driver accessory according to a third embodiment of the invention.
Figure 20:
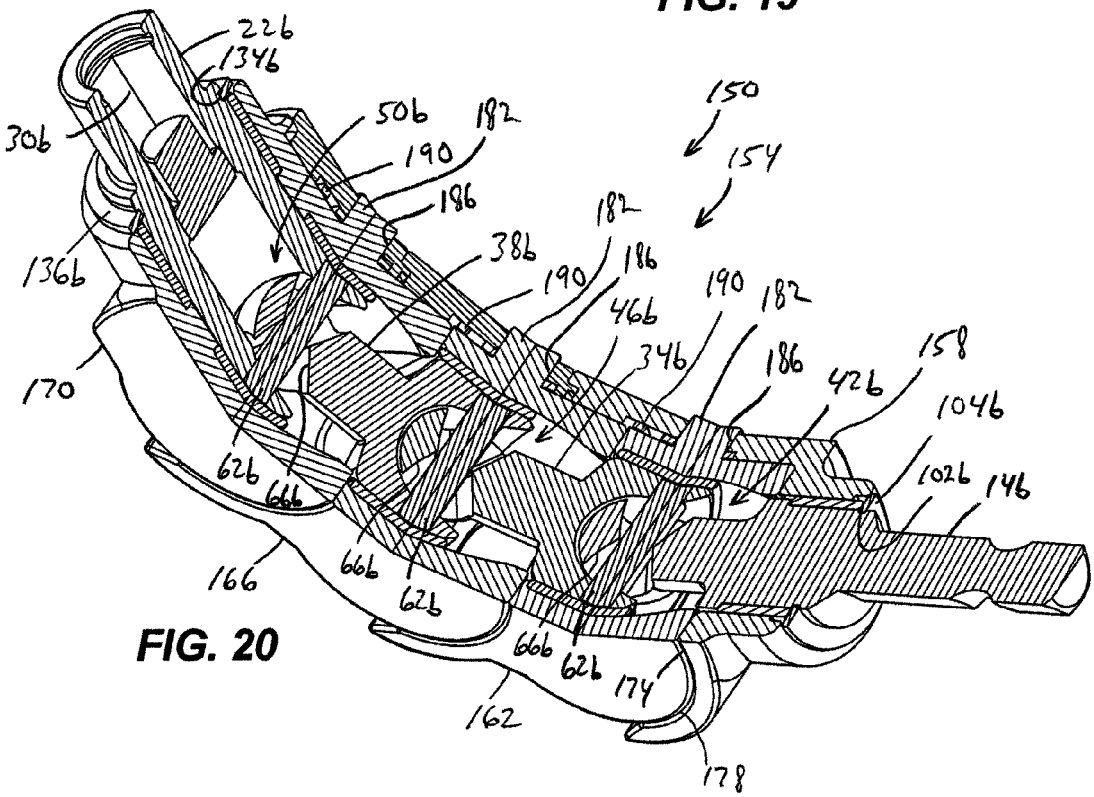
FIG. 20 is a cross-sectional view of the driver accessory of FIG. 19 taken along line 20-20 in FIG. 19.

FIGS. 19 and 20 illustrate a driver accessory 150 according to a third embodiment of the invention, with like components being labeled with like reference numerals with the letter "b." The driver accessory 150 includes a housing 154 having four portions 158, 162, 166, 170, each of which is pivotable with respect to an adjacent housing portion, to support the output shaft 22*b* in a particular orientation or position relative to the input shaft 14*b*.

With reference to FIG. 19, the first housing portion 158 includes a concave, cylindrical cam surface 174 and the second housing portion 162 includes a convex, cylindrical cam surface 178 engaged with the cam surface 174 of the first housing portion 158. The second housing portion 162 also includes a projection 182 (FIG. 20) substantially aligned with a plane containing a centerpoint of the pin 62*b* of the first joint 42*b*, and the first housing portion 158 includes an aperture 186 in which the projection 182 is received. Therefore, the second housing portion 162 is pivotable relative to the first housing portion 158, against the bias of a torsion spring 190. In the illustrated construction of the driver accessory 150, the circumferential length of the cam surface 174 on the first housing portion 158 is less than the circumferential length of the cam surface 178 on the second housing portion 162 to permit the second housing portion 162 to incline with respect to the first housing portion 158 by about 30 degrees. In other words, the first intermediate shaft 34*b* may be inclined relative to the input shaft 146 by about 30 degrees. Accordingly, the second housing portion 162 is rotatable about an axis of the projection 182 of the first joint 42*b* between a first rotational position, in which the first intermediate shaft 34*b* and the input shaft 14*b* are coaxial, and a second rotational position, in which the first intermediate shaft 34*b* is inclined by about 30 degrees with respect to the input shaft 14*b*.

The third and second housing portions 166, 162, and the fourth and third housing portions 170, 166, are rotatable relative to each other in the same way as the second and first housing portions 162, 158 discussed above. The driver accessory 150 may include a plurality of detents positioned between the housing portions 158, 162, 166, 170 to provide a positive stop when rotating the housing portions 158, 162, 166, 170 relative to each other.

The operation of the driver accessory 150 of FIGS. 19 and 20 is identical to the driver accessory 10 of FIGS. 1-3 and 7-17, and will not be described again in detail.

Figure 21:
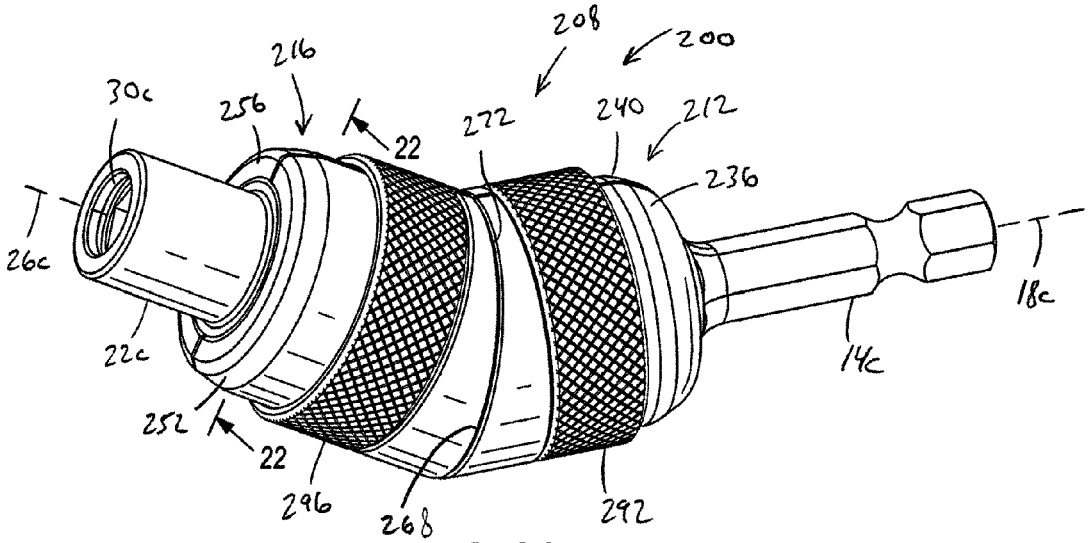
FIG. 21 is a perspective view of a driver accessory according to a fourth embodiment of the invention.
Figure 22:
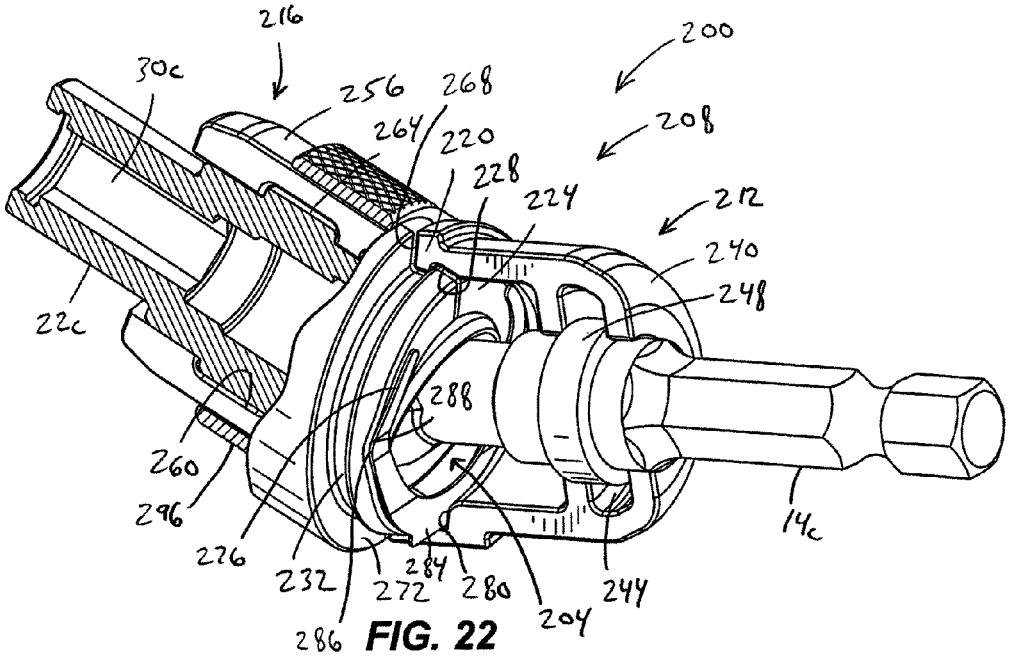
FIG. 22 is a perspective, cross-sectional view of the driver accessory of FIG. 21 taken along line 22-22 in FIG. 21.

FIGS. 21 and 22 illustrate a driver accessory 200 according to a fourth embodiment of the invention, with like components being labeled with like reference numerals with the letter "c." The driver accessory 200 includes an input shaft 14*c*, defining a longitudinal axis 18*c*, configured to receive torque from a driver (e.g., a drill, a hand driver, etc.). In the illustrated construction of the driver accessory 200, the input shaft 14*c* includes a hexagonal cross-sectional shape for engagement with a chunk of a drill or a hexagonal socket in a hand driver. Alternatively, the input shaft 14*c* may include any of a number of different shapes according to the particular configuration of the drill chuck and/or socket in the hand driver. The driver accessory 200 also includes an output shaft 22*c*, defining a longitudinal axis 26*c*, drivably coupled to the input shaft 14*c* to receive torque from the input shaft 14*c*. In the illustrated construction of the driver accessory 200, the output shaft 22*c* includes a socket 30*c* having a hexagonal cross-sectional shape configured to receive a tool bit having a hexagonal drive end. Alternatively, the socket 30*c* may be configured having any of a number of different cross-sectional shapes corresponding to the particular drive end configuration of the tool bit (e.g., a square bit, a star bit, etc.). As a further alternative, the output shaft 22*c* may include a head, having any of a number of different cross-sectional shapes, configured to be supported by a tool socket having a corresponding shape.

With reference to FIG. 22, the driver accessory 200 includes a ball-and-socket joint 204 identical to the ball-and-socket joints 67 shown in FIGS. 6 and 7 and described above. Alternatively, the ball-and-socket joint 204 may be configured as one of the universal joints 42, 46, 50 described above and shown in FIGS. 1-17. As a result, the output shaft 22*e* can be reoriented with respect to the input shaft 14*e* to increase the maneuverability of a drill or a hand driver when working in a tight or confined workspace.

With reference to FIGS. 21 and 22, the driver accessory 200 also includes a housing 208 in which the input shaft 14*c* and the output shaft 22*c* are at least partially received and supported. The housing 208 includes two portions, a first housing portion 212 and a second housing portion 216. Each of the housing portions 212, 216 is pivotable with respect to the other to support the output shaft 22*c* in a particular orientation or position relative to the input shaft 14*c*. The first housing portion 212 and the second housing portion 216 each have a tongue 220, 224 and a groove 228, 232 such that when the first and second housing portions 212, 216 are mated together, the tongue 220 and groove 228 of the first housing portion 212 interlocks with the tongue 224 and groove 232 of the second housing portion 216.

The first housing portion 212 includes two substantially mirrored halves 236, 240 such that when mated together define an annular slot 244 (FIG. 22). The respective halves 236, 240 of the first housing portion 212 receive a radial protrusion 248 of the input shaft 14*c* in the slot 244 and support the input shaft 14*c* for rotation. The slot 244 in the first housing portion 212 limits axial movement of the input shaft 14*c* within the first housing portion 212 in opposite directions. Although not shown, a bearing or a bushing may be utilized between the first housing portion 212 and the input shaft 14*c* to reduce friction between the first housing portion 212 and the input shaft 14*c*.

The second housing portion 216 includes two substantially mirrored halves 252, 256 that when mated together define an annular slot 260. The output shaft 22*c* includes a radial protrusion 264 that is received within the slot 260 to support the output shaft 22*c* for rotation and to limit axial movement of the output shaft 22*c* within the second housing portion 216 in opposite directions. Although not shown, a bearing or a bushing may be utilized between the second housing portion 216 and the output shaft 22*c* to reduce friction between the second housing portion 216 and the output shaft 22*c*.

With reference to FIG. 21, the first housing portion 212 includes an inclined cam surface 268, and the second housing portion 216 includes an inclined cam surface 272 that is engaged and in facing relationship with the cam surface 268 of the first housing portion 212. The cam surfaces 268, 272 are defined by a common plane (not shown) oriented obliquely to the longitudinal axes 18*c*, 26*c* of the input and output shafts 14*c*, 22*c*. As such, the second housing portion 216 is rotatable between a first rotational position, in which the directions of the inclined cam surfaces 268, 272 cancel each other thereby positioning the output shaft 22*c* coaxial with the input shaft 14*c*, and a second rotational position (FIGS. 21 and 22), in which the directions of the inclined cam surfaces 268, 272 are cumulative thereby inclining the output shaft 22*c* by about 30 degrees with respect to the input shaft 14*c*. Alternatively, the respective cam surfaces 268, 272 on the first and second housing portions 212, 216 may each be inclined more or less than about 15 degrees.

With reference to FIG. 22, the driver accessory 200 includes a resiliently deflectable spring clip 276 positioned between the first and second housing portions 212, 216. The first housing portion 212 includes a recess 280 in which a portion of the clip 276 (e.g., a tab 284) is received such that the clip 276 is rotationally fixed to the first housing portion 212. The driver accessory 200 includes a locking mechanism configured as a clip 276 having opposed detents 286 that are received within respective recesses 288 in the second housing portion 216 when the second housing portion 216 is in its first and second rotational positions with respect to the first housing portion 212.

With reference to FIG. 21, a first band 292 is coupled to the peripheral surface of the first housing portion 212 to clamp the first housing portion halves 236, 240 together. A second band 296 is coupled to the peripheral surface of the second housing portion 216 to clamp the second housing portion halves 252, 256 together. The bands 276, 280 include a knurled outer surface to enhance gripping the driver accessory 200.

In operation of the driver accessory 200, the input shaft 14*c* is secured to a chuck of a drill, or a socket of a hand driver, and a tool bit is inserted within the socket 30*c* in the output shaft 22*c*. The second housing portion 216 is then rotated between the first and second rotational positions to orient the output shaft 22*c* at a desired angle or position with respect to the input shaft 14*c*. For example, to orient the output shaft 22*c* at a substantially 30-degree angle with respect to the input shaft 14*c*, the second housing portion 216 is rotated to its second rotational position. Likewise, to orient the output shaft 22*c* substantially coaxial with the input shaft 14*c*, the second housing portion 216 is rotated to its first rotational position. The housing 208 supports the output shaft 22*c* relative to the input shaft 14*c* as torque from the input shaft 14*c* is transferred to the output shaft 22*c* via the joint 204, without any additional assistance from the operator of the drill and/or hand driver. As such, the operator may use their free hand to maintain the alignment of the fastener being driven into the workpiece during the initial period of insertion of the fastener into the workpiece.

Figure 23:
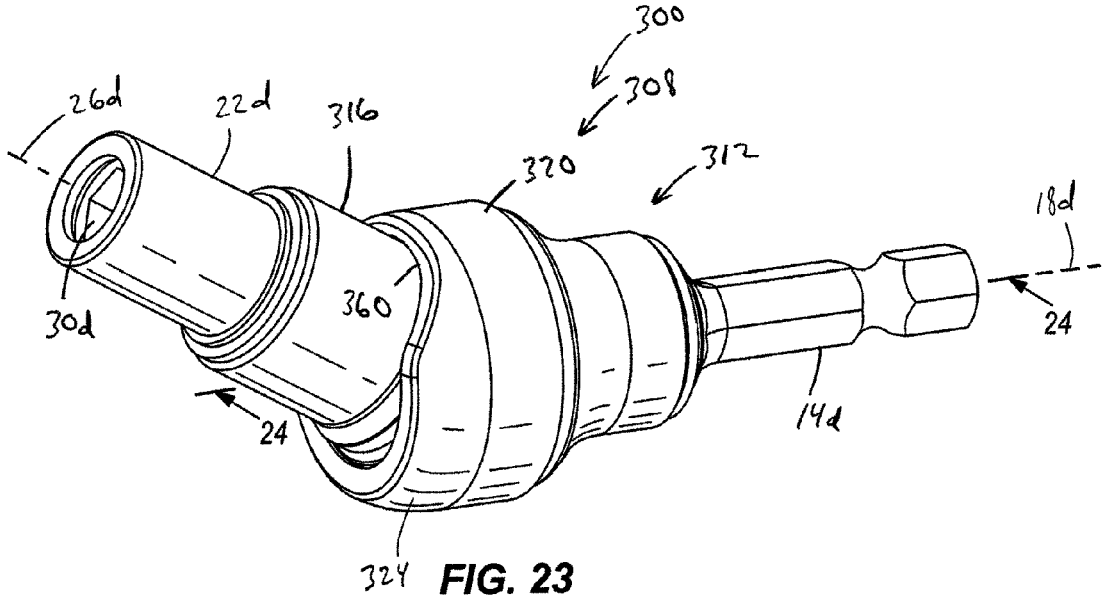
FIG. 23 is a perspective view of a driver accessory according to a fifth embodiment of the invention.
Figure 24:
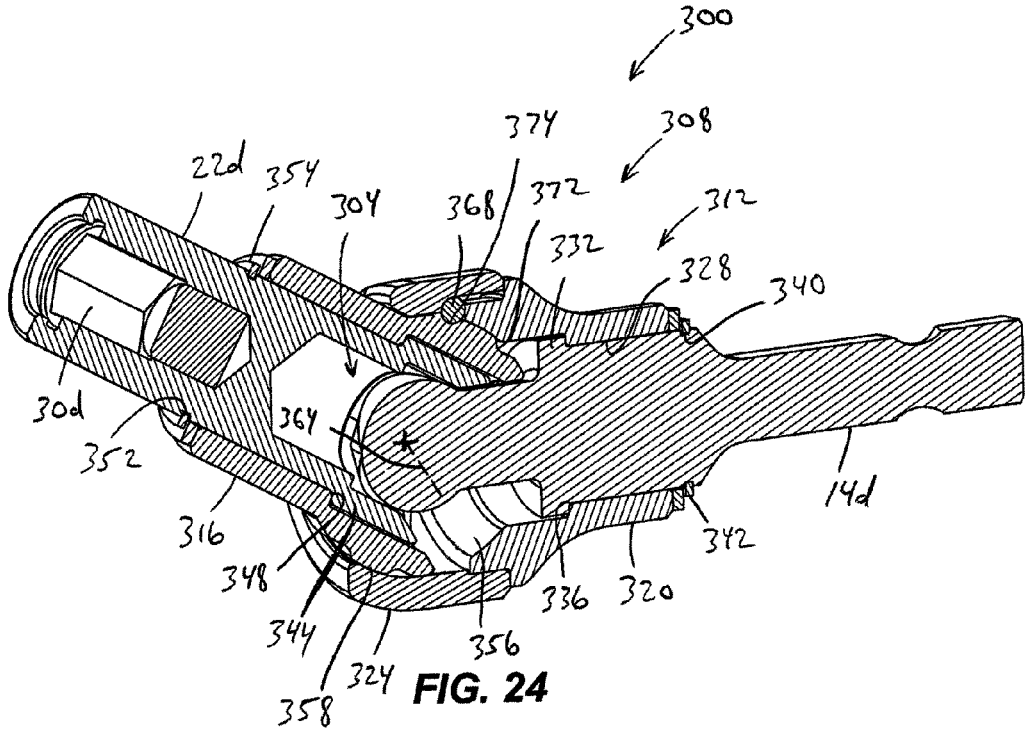
FIG. 24 is a perspective, cross-sectional view of the driver accessory of FIG. 23 taken along line 24-24 in FIG. 23.

FIGS. 23 and 24 illustrate a driver accessory 300 according to a fifth embodiment of the invention, with like components being labeled with like reference numerals with the letter "d." The driver accessory 300 includes an input shaft 14*d*, defining a longitudinal axis 18*d*, configured to receive torque from a driver (e.g., a drill, a hand driver, etc.). In the illustrated construction of the driver accessory 300, the input shaft 14*d* includes a hexagonal cross-sectional shape for engagement with a chunk of a drill or a hexagonal socket in a hand driver. Alternatively, the input shaft 14*d* may include any of a number of different shapes according to the particular configuration of the drill chuck and/or socket in the hand driver. The driver accessory 300 also includes an output shaft 22*d*, defining a longitudinal axis 26*d*, drivably coupled to the input shaft 14*d* to receive torque from the input shaft 14*d*. In the illustrated construction of the driver accessory 300, the output shaft 22*d* includes a socket 30*d* having a hexagonal cross-sectional shape configured to receive a tool bit having a hexagonal drive end. Alternatively, the socket 30*d* may be configured having any of a number of different cross-sectional shapes corresponding to the particular drive end configuration of the tool bit (e.g., a square bit, a star bit, etc.). As a further alternative, the output shaft 22*d* may include a head, having any of a number of different cross-sectional shapes, configured to be supported by a tool socket having a corresponding shape.

With reference to FIG. 24, the driver accessory 300 includes a ball-and-socket joint 304 identical to the joint 204 described above and shown in FIGS. 21 and 22 to permit the output shaft 22*d* and the input shaft 14*d* to articulate relative to each other. Alternatively, the ball-and-socket joint 304 may be configured as one of the universal joints 42, 46, 50 described above and shown in FIGS. 1-17. As a result, the output shaft 22*d* can be reoriented with respect to the input shaft 14*d* to increase the maneuverability of a drill or a hand driver when working in a tight or confined workspace.

With reference to FIGS. 23 and 24, the driver accessory 300 also includes a housing 308 in which the input shaft 14*d* and the output shaft 22*d* are at least partially received and supported. As shown in FIG. 24 and as described in some detail below, the housing 308 includes a first housing portion 312 having a first piece 320 and a second piece 324 fixed to the first piece 320 to facilitate assembly of the driver accessory 300. The housing 308 also includes a second housing portion 316 that is pivotable relative to the first housing portion 312 to support the output shaft 22*d* in a particular orientation or position relative to the input shaft 14*d*. The first housing portion 312 includes an aperture 328 in which the input shaft 14*d* is received and supported for rotation. The input shaft 14*d* includes a radial protrusion 332 positioned adjacent an interior face 336 of the first housing portion 312 to limit axial movement of the input shaft 14*d* relative to the first housing portion 312 in a first direction. The input shaft 14*d* also includes a circumferential groove 340 in the outer periphery of the input shaft 14*d* in which a retaining ring 342 is received to limit axial movement of the input shaft 14*d* relative to the first housing portion 312 in an opposite, second direction. Although not shown, a bearing or a bushing may be utilized between the first housing portion 312 and the input shaft 14*d* to reduce friction between the first housing portion 312 and the input shaft 14*d*.

With continued reference to FIG. 24, the output shaft 22*d* is supported within the second housing portion 316 for rotation about the longitudinal axis 26*d* of the output shaft 22*d*. The output shaft 22*d* includes a radial protrusion 344 positioned adjacent an interior face 348 of the second housing portion 316 to limit axial movement of the output shaft 22*d*, relative to the second housing portion 316, away from the input shaft 14*d*. The output shaft 22*d* also includes a circumferential groove 352 in the outer periphery of the output shaft 22*d* in which a retaining ring 354 is received to limit axial movement of the output shaft 22*d*, relative to the second housing portion 316, toward the input shaft 14*d*. Although not shown, a bearing or a bushing may be utilized between the second housing portion 316 and the output shaft 22*d* to reduce friction between the second housing portion 316 and the output shaft 22*d*.

With reference to FIG. 24, the first and second pieces 320, 324 of the first housing portion 312 collectively define a socket 356. The second housing portion 316 defines a ball 358 that is received in the socket 356. The second piece 324 of the first housing portion 312 includes an opening 360 (FIG. 23) that is tapered toward the input shaft 14*d* to permit the output shaft 22*d* to pivot upwardly from the frame of reference of FIG. 23. In the illustrated construction of the driver accessory 300, the second housing portion 316 is positioned in the socket 356 such that the output shaft 22*d* is inclined with respect to a reference plane (not shown) that is normal to the longitudinal axis 18*d* of the input shaft 14*d* by about 30 degrees. As such, the second housing portion 316 is pivotable about an axis 364 that is normal to the longitudinal axis 18*d* of the input shaft 14*d* between a first pivotal position, in which the output shaft 22*d* is coaxial with the input shaft 14*d*, and a second pivotal position (FIGS. 23 and 24), in which the output shaft 22*d* is inclined by about 30 degrees with respect to the longitudinal axis 18*d* of the input shaft 14*d*. Alternatively, the second housing portion 316 may be inclined more or less than about 30 degrees.

With reference to FIG. 24, the driver accessory 300 includes a locking mechanism configured as a detent 368 supported by the first housing portion 312, and two recesses 372, 374 defined on the ball 358 of the second housing portion 316. The detent 368 is configured as a resilient cylinder which may be received in either of the recesses 372, 374 to secure the second housing portion 316 in the first and second pivotal positions mentioned above. Accordingly, when switching between the first and second pivotal positions, the detent 368 is moved out of one of the recesses 372, 374 and into the other of the recesses 372, 374. Alternatively, the detent 368 may be supported by the second housing portion 316, and the recesses 372, 374 may be defined on an inner surface of the first housing portion 312. Alternatively, other structure and/or components may be employed to provide a positive stop between the first and second housing portions 312, 316 when pivoting the second housing portion 316 relative to the first housing portion 312.

In operation of the driver accessory 300, the input shaft 14*d* is secured to a chuck of a drill, or a socket of a hand driver, and a tool bit is inserted within the socket 30*d* of the output shaft 22*d*. The second housing portion 316 is then pivoted between the first and second pivotal positions to orient the output shaft 22*d* at a desired angle or position with respect to the input shaft 14*d*. For example, to orient the output shaft 22*d* at a substantially 30-degree angle with respect to the input shaft 14*d*, the second housing portion 316 is pivoted to its second pivotal position (FIGS. 23 and 24). Likewise, to orient the output shaft 22*d* substantially coaxial with the input shaft 14*d*, the second housing portion 316 is pivoted to its first pivotal position. The housing 308 supports the output shaft 22*d* relative to the input shaft 14*d* as torque from the input shaft 14*d* is transferred to the output shaft 22*d* via the joint 304, without any additional assistance from the operator of the drill and/or hand driver. As such, the operator may use their free hand to maintain the alignment of the fastener being driven into the workpiece during the initial period of insertion of the fastener into the workpiece.

Figure 25:
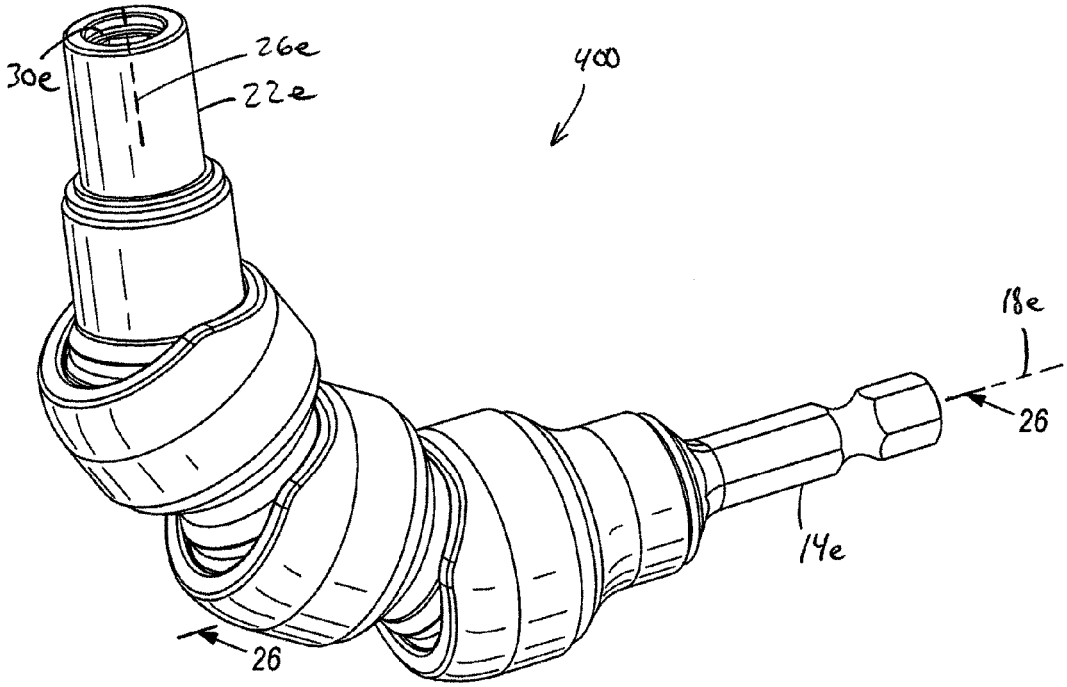
FIG. 25 is a perspective view of a driver accessory according to a sixth embodiment of the invention.
Figure 26:
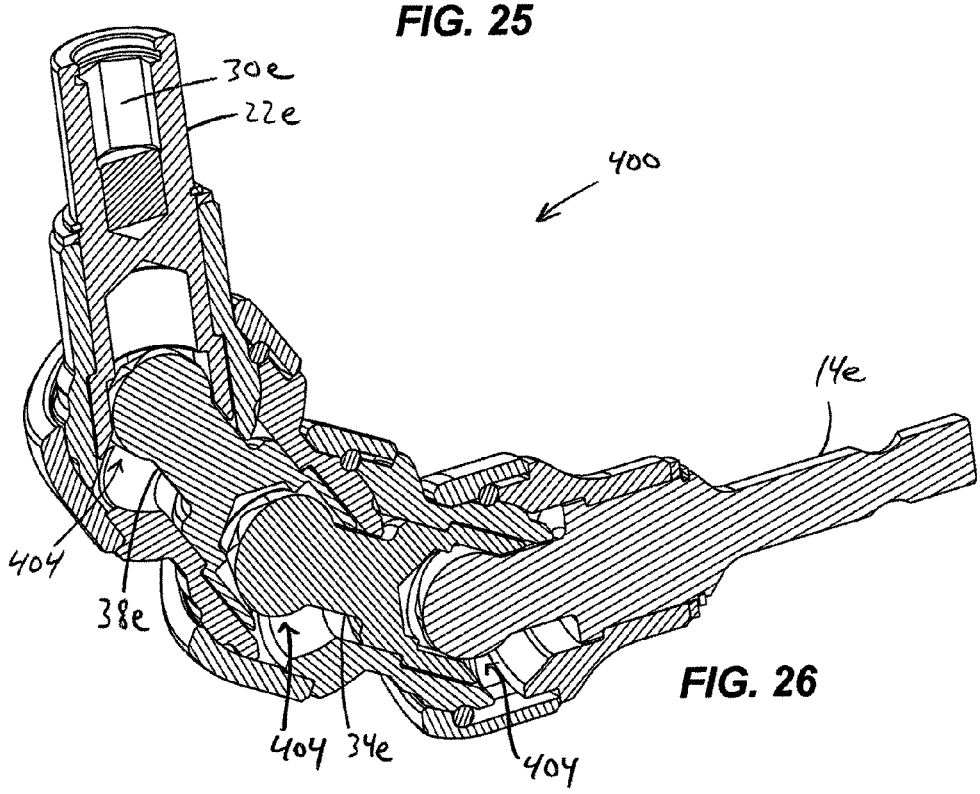
FIG. 26 is a perspective, cross-sectional view of the driver accessory of FIG. 25 taken along line 26-26 in FIG. 25.

FIGS. 25 and 26 illustrate a driver accessory 400 according to a sixth embodiment of the invention, with like components being labeled with like reference numerals with the letter "e." The driver accessory 400 is substantially identical to the driver accessory 300 of FIGS. 23 and 24, with the exception of the two intermediate shafts 34*e*, 38*e* interconnecting the input shaft 14*e* and the output shaft 22*e* (FIG. 26). Like the driver accessory 10 of FIGS. 1-3 and 7-17, the driver accessory 400 includes three ball-and-socket joints 404, each of which is identical to the joint 204 described above and shown in FIGS. 21 and 22 to permit the output shaft 22*e* and the input shaft 14*e* to articulate relative to each other. Alternatively, the ball-and-socket joints 404 may be configured as one of the universal joints 42, 46, 50 described above and shown in FIGS. 1-17. As each of the joints 404 permits up to about 30 degrees of movement, the output shaft 22*e* may be oriented relative to the input shaft 14*e* by up to about 90 degrees. The operation of the driver accessory 400 of FIGS. 25 and 26 is otherwise identical to the driver accessory 300 of FIGS. 23 and 24, and will not be described again in detail.

Figure 27:
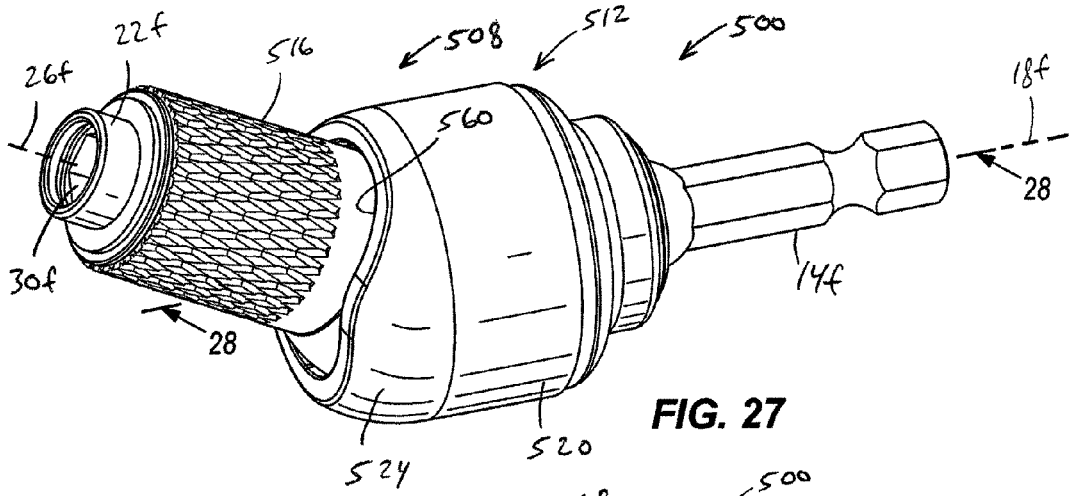
FIG. 27 is a perspective view of a driver accessory according to a seventh embodiment of the invention.
Figure 28:
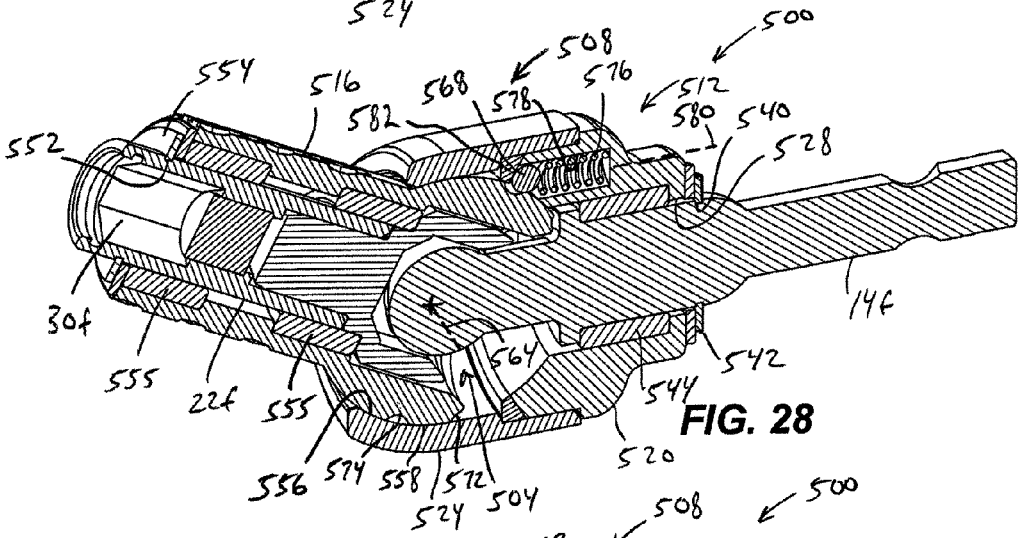
FIG. 28 is a perspective, cross-sectional view of the driver accessory of FIG. 27 taken along line 28-28 in FIG. 27.
Figure 29:
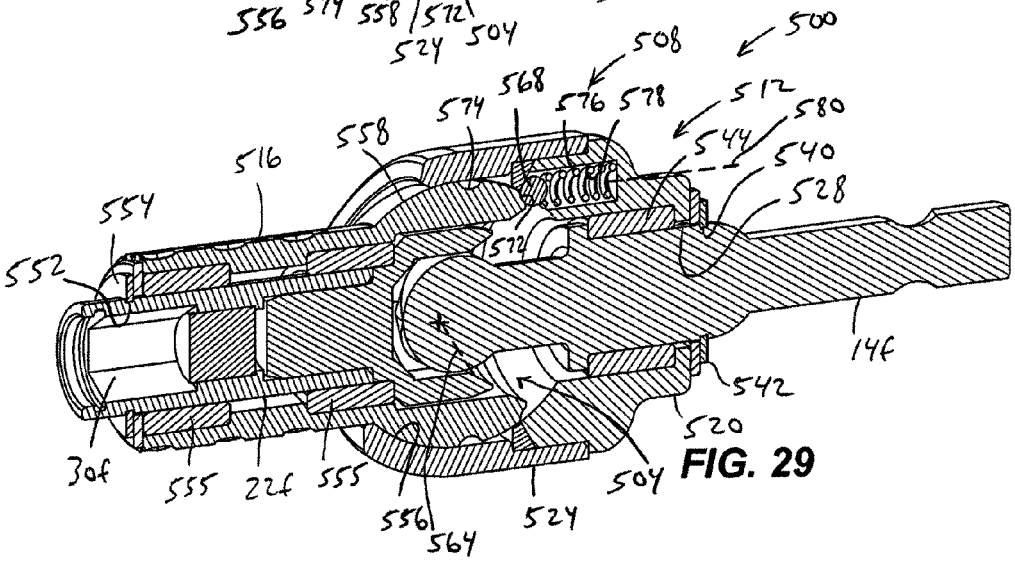
FIG. 29 is a cross-sectional view of the driver accessory of FIG. 28.

FIGS. 27-29 illustrate a driver accessory 500 according to a seventh embodiment of the invention, with like components being labeled with like reference numerals with the letter "f." The driver accessory 500 includes an input shaft 14*f*, defining a longitudinal axis 18*f*, configured to receive torque from a driver (e.g., a drill, a hand driver, etc.). In the illustrated construction of the driver accessory 500, the input shaft 14*f* includes a hexagonal cross-sectional shape for engagement with a chunk of a drill or a hexagonal socket in a hand driver.

Alternatively, the input shaft 14*f* may include any of a number of different shapes according to the particular configuration of the drill chuck and/or socket in the hand driver. The driver accessory 500 also includes an output shaft 22*f*, defining a longitudinal axis 26*f*, drivably coupled to the input shaft 14*f* to receive torque from the input shaft 14*f*. In the illustrated construction of the driver accessory 500, the output shaft 22*f* includes a socket 30*f* having a hexagonal cross-sectional shape configured to receive a tool bit having a hexagonal drive end. Alternatively, the socket 30*f* may be configured having any of a number of different cross-sectional shapes corresponding to the particular drive end configuration of the tool bit (e.g., a square bit, a star bit, etc.). As a further alternative, the output shaft 22*f* may include a head, having any of a number of different cross-sectional shapes, configured to be supported by a tool socket having a corresponding shape.

With reference to FIG. 28, the driver accessory 500 includes a ball-and-socket joint 504 identical to the joint 204 described above and shown in FIGS. 21 and 22 to permit the output shaft 22*f* and the input shaft 14*f* to articulate relative to each other. Alternatively, the ball-and-socket joint 504 may be configured as one of the universal joints 42, 46, 50 described above and shown in FIGS. 1-17. As a result, the output shaft 22*f* can be reoriented with respect to the input shaft 14*f* to increase the maneuverability of a drill or a hand driver when working in a tight or confined workspace.

With reference to FIGS. 27-29, the driver accessory 500 also includes a housing 508 in which the input shaft 14*f* and the output shaft 22*f* are at least partially received and supported. As shown in FIGS. 28 and 29, the housing 508 includes a first housing portion 512 having a first piece 520 and a second piece 524 fixed to the first piece 520 to facilitate assembly of the driver accessory 500. The housing 508 also includes a second housing portion 516 that is pivotable relative to the first housing portion 512 to support the output shaft 22*f* in a particular orientation or position relative to the input shaft 14*f*. The first housing portion 512 includes an aperture 528 in which the input shaft 14*f* is received and supported for rotation. The input shaft 14*f* includes a circumferential groove 540 in the outer periphery of the input shaft 14*f* in which a retaining ring 542 is received to limit axial movement of the input shaft 14*f*, relative to the first housing portion 512, toward the output shaft 22*f*. A bearing or a bushing 544 is utilized between the first housing portion 512 and the input shaft 14*f* to reduce friction between the first housing portion 512 and the input shaft 14*f*.

With continued reference to FIGS. 28 and 29, the output shaft 22*f* is supported within the second housing portion 516 for rotation about the longitudinal axis 26*f* of the output shaft 22*f*. The output shaft 22*f* includes a circumferential groove 552 in the outer periphery of the output shaft 22*f* in which a retaining ring 554 is received to limit axial movement of the output shaft 22*f*, relative to the second housing portion 516, toward the input shaft 14*f*. Spaced bearings or bushings 555 are utilized between the second housing portion 516 and the output shaft 22*f* to reduce friction between the second housing portion 516 and the output shaft 22*f*.

The first and second pieces 520, 524 of the first housing portion 512 collectively define a socket 556. The second housing portion 516 defines a ball 558 that is received in the socket 556. The second piece 524 of the first housing portion 512 includes an opening 560 that is tapered toward the input shaft 14*f* to permit the output shaft 22*f* to pivot upwardly from the frame of reference of FIG. 27. In the illustrated construction of the driver accessory 500, the second housing portion 516 is positioned in the socket 556 such that the output shaft 22*f* is inclined with respect to a reference plane (not shown) that is normal to the longitudinal axis 18*f* of the input shaft 14*f* by about 30 degrees. As such, the second housing portion 516 is pivotable about an axis 564 that is normal to the longitudinal axis 18*f* of the input shaft 14*f* between a first pivotal position, in which the output shaft 22*f* is coaxial with the input shaft 14*f*, and a second pivotal position (FIGS. 27-29), in which the output shaft 22*f* is inclined by about 30 degrees with respect to the longitudinal axis 18*f* of the input shaft 14*f*. Alternatively, the second housing portion 516 may be inclined more or less than about 30 degrees.

With reference to FIGS. 28 and 29, the driver accessory 500 includes a locking mechanism configured as a detent 568 supported by the first housing portion 512, and two recesses 572, 574 defined on the ball 558 of the second housing portion 516. The detent 568 is biased toward the second housing portion 516 by a resilient member (e.g., a spring 576), and the detent 568 and the spring 576 are positioned within an aperture 578 in the first housing portion 512. The spring 576 and the aperture 578 are coaxially aligned with an axis 580 oriented substantially parallel with the longitudinal axis 18*f* of the input shaft 14*f*. The driver accessory 500 includes a deflector 582 against which the detent 568 is engaged to redirect the force exerted by the spring 576 downward (i.e., from the frame of reference of FIGS. 28 and 29) toward the recesses 572, 574. Alternatively, the deflector 582 may be omitted, and the spring 576 and the aperture 578 may be oriented at an incline or substantially vertically from the frame of reference of FIGS. 28 and 29. The detent 568 may be received in either of the recesses 572, 574 to secure the second housing portion 516 in the first (FIG. 29) and second (FIG. 28) pivotal positions mentioned above. Accordingly, when switching between the first and second pivotal positions, the detent 568 is moved out of one of the recesses 572, 574 against the bias of the spring 576 and into the other of the recesses 572, 574. Alternatively, the detent 568 may be supported by the second housing portion 516, and the recesses 572, 574 may be defined on an inner surface of the first housing portion 512. Alternatively, other structure and/or components may be employed to provide a positive stop between the first and second housing portions 512, 516 when pivoting the second housing portion 516 relative to the first housing portion 512.

In operation of the driver accessory 500, the input shaft 14*f* is secured to a chuck of a drill, or a socket of a hand driver, and a tool bit is inserted within the socket 30*f* of the output shaft 22*f*. The second housing portion 516 is then pivoted between the first and second pivotal positions to orient the output shaft 22*f* at a desired angle or position with respect to the input shaft 14*f*. For example, to orient the output shaft 22*f* at a substantially 30-degree angle with respect to the input shaft 14*f*, the second housing portion 516 is pivoted to its second pivotal position (FIG. 28), in which the detent 568 is received within the recess 574. Likewise, to orient the output shaft 22*f* substantially coaxial with the input shaft 14*f*, the second housing portion 516 is pivoted to its first pivotal position (FIG. 29), in which the detent 568 is received within the recess 572. The housing 508 supports the output shaft 22*f* relative to the input shaft 14*f* as torque from the input shaft 14*f* is transferred to the output shaft 22*f* via the joint 504, without any additional assistance from the operator of the drill and/or hand driver. As such, the operator may use their free hand to maintain the alignment of the fastener being driven into the workpiece during the initial period of insertion of the fastener into the workpiece.

Figure 30:
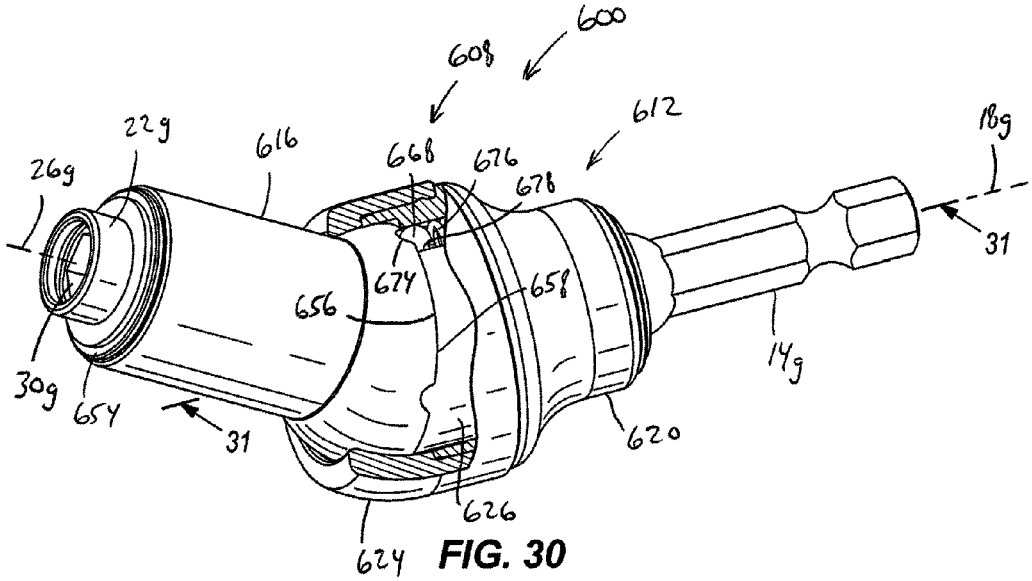
FIG. 30 is a perspective view of a driver accessory according to an eighth embodiment of the invention.
Figure 31:
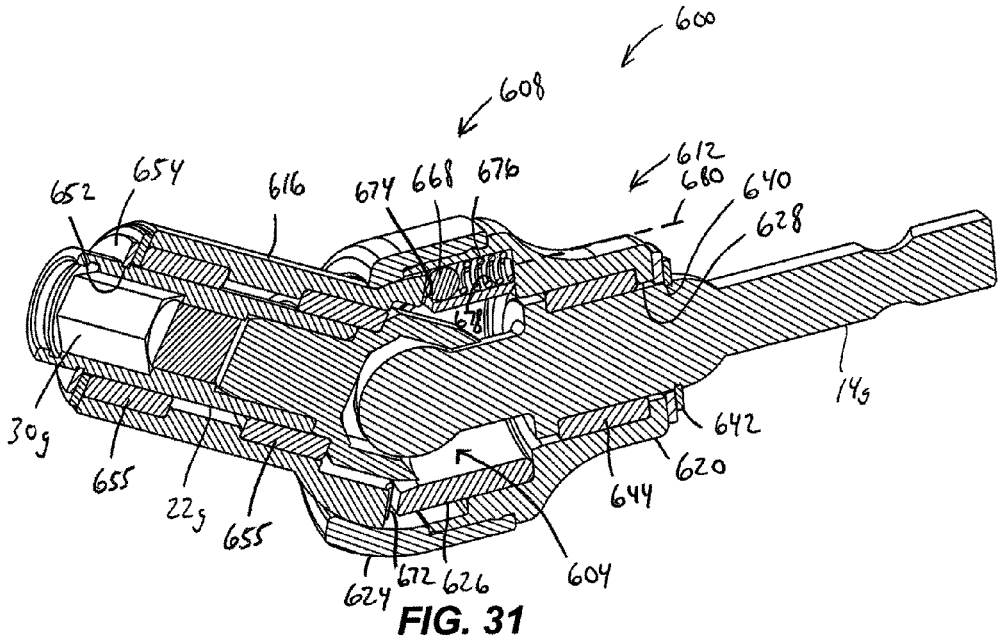
FIG. 31 is a perspective, cross-sectional view of the driver accessory of FIG. 29 taken along line 31-31 in FIG. 30.

FIGS. 30 and 31 illustrate a driver accessory 600 according to an eighth embodiment of the invention, with like components being labeled with like reference numerals with the letter "g." The driver accessory 600 includes an input shaft 14*g*, defining a longitudinal axis 18*g*, configured to receive torque from a driver (e.g., a drill, a hand driver, etc.). In the illustrated construction of the driver accessory 600, the input shaft 14*g* includes a hexagonal cross-sectional shape for engagement with a chunk of a drill or a hexagonal socket in a hand driver. Alternatively, the input shaft 14*g* may include any of a number of different shapes according to the particular configuration of the drill chuck and/or socket in the hand driver. The driver accessory 600 also includes an output shaft 22*g*, defining a longitudinal axis 26*g*, drivably coupled to the input shaft 14*g* to receive torque from the input shaft 14*g*. In the illustrated construction of the driver accessory 600, the output shaft 22*g* includes a socket 30*g* having a hexagonal cross-sectional shape configured to receive a tool bit having a hexagonal drive end. Alternatively, the socket 30*g* may be configured having any of a number of different cross-sectional shapes corresponding to the particular drive end configuration of the tool bit (e.g., a square bit, a star bit, etc.). As a further alternative, the output shaft 22*g* may include a head, having any of a number of different cross-sectional shapes, configured to be supported by a tool socket having a corresponding shape.

With reference to FIG. 31, the driver accessory 600 includes a ball-and-socket joint 604 identical to the joint 204 described above and shown in FIGS. 21 and 22 to permit the output shaft 22*g* and the input shaft 14*g* to articulate relative to each other. Alternatively, the ball-and-socket joint 604 may be configured as one of the universal joints 42, 46, 50 described above and shown in FIGS. 1-17. As a result, the output shaft 22*g* can be reoriented with respect to the input shaft 14*g* to increase the maneuverability of a drill or a hand driver when working in a tight or confined workspace.

With reference to FIGS. 30 and 31, the driver accessory 600 also includes a housing 608 in which the input shaft 14*g* and the output shaft 22*g* are at least partially received and supported. The housing 608 includes a first housing portion 612 having a first piece 620 and a second piece 624 fixed to the first piece 620 to facilitate assembly of the driver accessory 600. The housing 608 also includes a second housing portion 616 that is pivotable relative to the first housing portion 612 to support the output shaft 22*g* in a particular orientation or position relative to the input shaft 14*g*. The first housing portion 612 further includes a third piece 626, which is discussed in more detail below, nested within the first and second pieces 620, 624. The first housing portion 612 includes an aperture 628 in which the input shaft 14*g* is received and supported for rotation. The input shaft 14*g* includes a circumferential groove 640 in the outer periphery of the input shaft 14*g* in which a retaining ring 642 is received to limit axial movement of the input shaft 14*g*, relative to the first housing portion 612, toward the output shaft 22*g*. As shown in FIG. 31, a bearing or a bushing 644 is utilized between the first housing portion 612 and the input shaft 14*g* to reduce friction between the first housing portion 612 and the input shaft 14*g*.

With continued reference to FIG. 31, the output shaft 22*g* is supported within the second housing portion 616 for rotation about the longitudinal axis 26*g* of the output shaft 22*g*. The output shaft 22*g* includes a circumferential groove 652 in the outer periphery of the output shaft 22*g* in which a retaining ring 654 is received to limit axial movement of the output shaft 22*g*, relative to the second housing portion 516, toward the input shaft 14*g*. Spaced bearings or a bushings 655 are utilized between the second housing portion 616 and the output shaft 22*g* to reduce friction between the second housing portion 616 and the output shaft 22*g*.

With reference to FIG. 31, the third piece 626 of first housing portion 612 includes an inclined cam surface 656, and the second housing portion 616 includes an inclined cam surface 658 that is engaged and in facing relationship with the cam surface 656 of the first housing portion 612. The cam surfaces 656, 658 are defined by a common plane oriented obliquely to the longitudinal axis 18*g* of the input shaft 14*g*. In the illustrated construction of the driver accessory 600, each of the cam surfaces 656, 658 and the common plane are inclined with respect to a reference plane that is normal to the longitudinal axis 18*g* of the input shaft 14*g* by about 15 degrees. As such, the second housing portion 616 is rotatable about the longitudinal axis 18*g* of the input shaft 14*g* between a first rotational position, in which the directions of the inclined cam surfaces 656, 658 cancel each other thereby positioning the output shaft 22*g* coaxial with the input shaft 14*g*, and a second rotational position (FIGS. 30 and 31), in which the directions of the inclined cam surfaces 656, 658 are cumulative thereby inclining the output shaft 22*g* by about 30 degrees with respect to the input shaft 14*g*.

With reference to FIG. 31, the driver accessory 600 includes a locking mechanism configured as a detent 668 supported by the first housing portion 612, and two recesses 672, 674 defined in the inclined cam surface 658 on the second housing portion 616. The detent 668 is biased toward the second housing portion 616 by a resilient member (e.g., a spring 676), and the detent 668 and the spring 676 are positioned within a groove 678 in the third piece 626 of the first housing portion 612. The spring 676 and the groove 678 are coaxially aligned with an axis 680 oriented substantially parallel with the longitudinal axis 18*g* of the input shaft 14*g*. The detent 668 may be received in either of the recesses 672, 674 to secure the second housing portion 616 in the first and second pivotal positions mentioned above. Accordingly, when switching between the first and second pivotal positions, the detent 668 is moved out of one of the recesses 672, 674 against the bias of the spring 676 and into the other of the recesses 672, 674. Alternatively, the detent 668 may be supported by the second housing portion 616, and the recesses 672, 674 may be defined on an inner surface of the first housing portion 612. Alternatively, other structure and/or components may be employed to provide a positive stop between the first and second housing portions 612, 616 when pivoting the second housing portion 616 relative to the first housing portion 612.

Furthermore, the driver accessory 600 may be adjusted such that the output shaft 22*g* is inclined relative to the input shaft 14*g* anywhere between 0 degrees and about 30 degrees by rotating the second housing portion 616 relative to the first housing portion 612 to a rotational position somewhere between the first and second rotational positions mentioned above. Alternatively, the respective cam surfaces 656, 658 may be inclined more or less than about 15 degrees.

In operation of the driver accessory 600, the input shaft 14*g* is secured to a chuck of a drill, or a socket of a hand driver, and a tool bit is inserted within the socket 30*g* of the output shaft 22*g*. The second housing portion 616 is then rotated between the first and second rotational positions to orient the output shaft 22*g* at a desired angle or position with respect to the input shaft 14*g*. For example, to orient the output shaft 22*g* at a substantially 30-degree angle with respect to the input shaft 14*g*, the second housing portion 616 is rotated to its second rotational position, in which the detent 668 is received within the recess 674. Likewise, to orient the output shaft 22*g* substantially coaxial with the input shaft 14*g*, the second housing portion 616 is pivoted to its first pivotal position, in which the detent 668 is received within the recess 672. The housing 608 supports the output shaft 22*g* relative to the input shaft 14*g* as torque from the input shaft 14*g* is transferred to the output shaft 22*g* via the joint 604, without any additional assistance from the operator of the drill and/or hand driver. As such, the operator may use their free hand to maintain the alignment of the fastener being driven into the workpiece during the initial period of insertion of the fastener into the workpiece.

Figure 32:
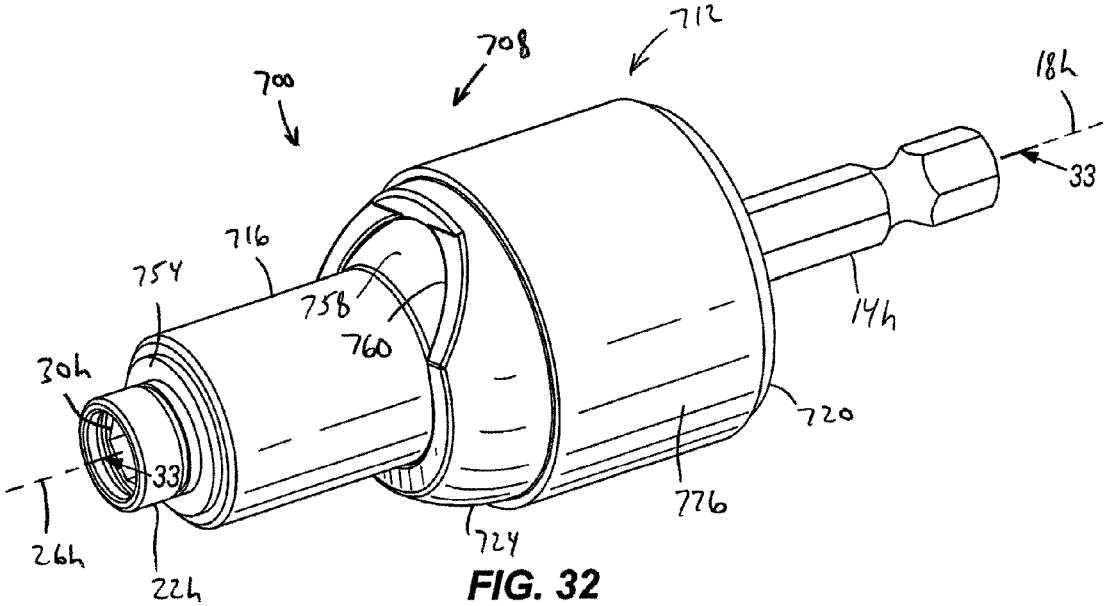
FIG. 32 is a perspective view of a driver accessory according to an ninth embodiment of the invention.
Figure 33:
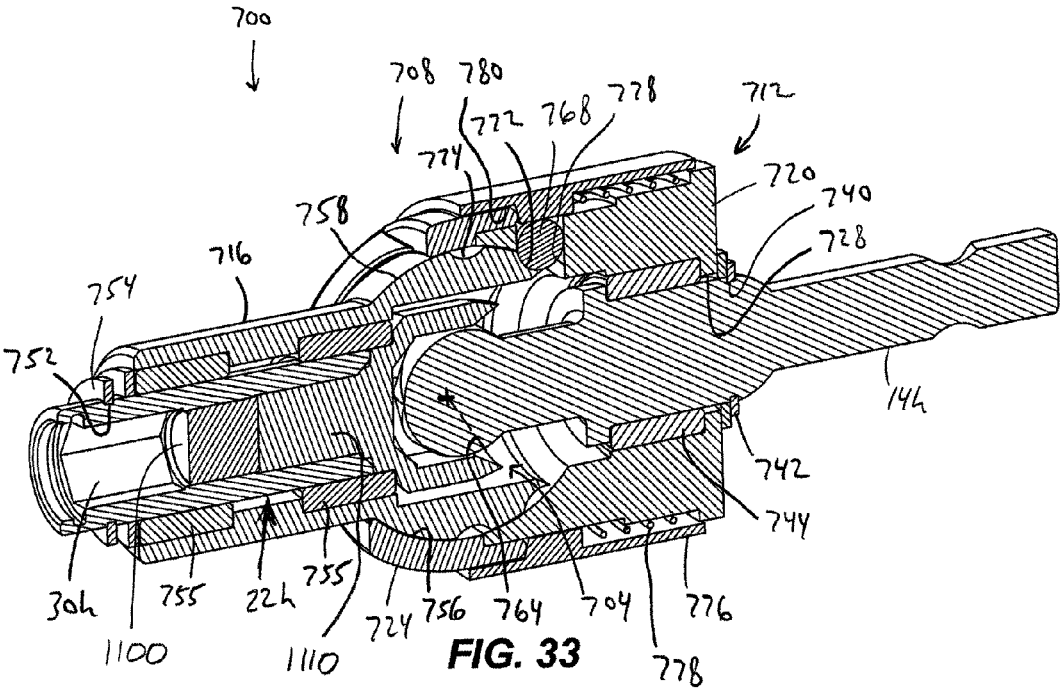
FIG. 33 is a perspective, cross-sectional view of the driver accessory of FIG. 31 taken along line 33-33 in FIG. 32.

FIGS. 32 and 33 illustrate a driver accessory 700 according to a ninth embodiment of the invention, with like components being labeled with like reference numerals with the letter "h." The driver accessory 700 includes an input shaft 14*h*, defining a longitudinal axis 18*h*, configured to receive torque from a driver (e.g., a drill, a hand driver, etc.). In the illustrated construction of the driver accessory 700, the input shaft 14*h* includes a hexagonal cross-sectional shape for engagement with a chunk of a drill or a hexagonal socket in a hand driver. Alternatively, the input shaft 14*h* may include any of a number of different shapes according to the particular configuration of the drill chuck and/or socket in the hand driver. The driver accessory 700 also includes an output shaft 22*h*, defining a longitudinal axis 26*h*, drivably coupled to the input shaft 14*h* to receive torque from the input shaft 14*h*. In the illustrated construction of the driver accessory 700, the output shaft 22*h* includes a socket 30*h* having a hexagonal cross-sectional shape configured to receive a tool bit having a hexagonal drive end. Alternatively, the socket 30*h* may be configured having any of a number of different cross-sectional shapes corresponding to the particular drive end configuration of the tool bit (e.g., a square bit, a star bit, etc.). As a further alternative, the output shaft 22*h* may include a head, having any of a number of different cross-sectional shapes, configured to be supported by a tool socket having a corresponding shape. It should be noted that in preferred constructions, the output shaft 22*h* includes the socket 30*h*, a magnet 1100, and a socket portion 1110. In order for the magnet 1100 to efficiently retain the tool in position, it is desirable that the socket 30*h* be formed from a non-magnetic material such as stainless steel. To improve the strength of the output shaft 22*h*, the socket portion 1110 is formed from hardened steel. Of course, other materials and arrangements could be used if desired.

With reference to FIG. 32, the driver accessory 700 includes a ball-and-socket joint 704 identical to the joint 204 described above and shown in FIGS. 21 and 22 to permit the output shaft 22*h* and the input shaft 14*h* to articulate relative to each other. Alternatively, the ball-and-socket joint 704 may be configured as one of the universal joints 42, 46, 50 described above and shown in FIGS. 1-17. As a result, the output shaft 22*h* can be reoriented with respect to the input shaft 14*h* to increase the maneuverability of a drill or a hand driver when working in a tight or confined workspace.

With reference to FIGS. 32 and 33, the driver accessory 700 also includes a housing 708 in which the input shaft 14*h* and the output shaft 22*h* are at least partially received and supported. The housing 708 includes a first housing portion 712 having a first piece 720 and a second piece 724 fixed to the first piece 720 to facilitate assembly of the driver accessory 700. The housing 708 also includes a second housing portion 716 that is pivotable relative to the first housing portion 712 to support the output shaft 22*h* in a particular orientation or position relative to the input shaft 14*h*. The first housing portion 712 includes an aperture 728 in which the input shaft 14*h* is received and supported for rotation. The input shaft 14*h* includes a circumferential groove 740 in the outer periphery of the input shaft 14*h* in which a retaining ring 742 is received to limit axial movement of the input shaft 14*h*, relative to the first housing portion 712, toward the output shaft 22*h*. As shown in FIG. 33, a bearing or a bushing 744 is utilized between the first housing portion 712 and the input shaft 14*h* to reduce friction between the first housing portion 712 and the input shaft 14*h*.

With continued reference to FIG. 33, the output shaft 22*h* is supported within the second housing portion 716 for rotation about the longitudinal axis 26*h* of the output shaft 22*h*. The output shaft 22*h* includes a circumferential groove 752 in the outer periphery of the output shaft 22*h* in which a retaining ring 754 is received to limit axial movement of the output shaft 22*h*, relative to the second housing portion 716, toward the input shaft 14*h*. Spaced bearings or bushings 755 are utilized between the second housing portion and the output shaft 22*h* to reduce friction between the second housing portion 716 and the output shaft 22*h*.

The first and second pieces 720, 724 of the first housing portion 712 collectively define a socket 756. The second housing portion 716 defines a ball 758 that is received in the socket 756. The second piece 724 of the first housing portion 712 includes an opening 760 that is tapered toward the input shaft 14*h* to permit the output shaft 22*h* to pivot upwardly from the frame of reference of FIG. 32. In the illustrated construction of the driver accessory 700, the second housing portion 716 is positioned in the socket 756 such that the output shaft 22*h* is inclined with respect to a reference plane (not shown) that is normal to the longitudinal axis 18*h* of the input shaft 14*h* by about 30 degrees. As such, the second housing portion 716 is pivotable about an axis 764 (FIG. 33) that is normal to the longitudinal axis 18*h* of the input shaft 14*h* between a first pivotal position (FIGS. 32 and 33), in which the output shaft 22*h* is coaxial with the input shaft 14*h*, and a second pivotal position, in which the output shaft 22*h* is inclined by about 30 degrees with respect to the longitudinal axis 18*h* of the input shaft 14*h*. Alternatively, the second housing portion 716 may be inclined more or less than about 30 degrees.

With reference to FIG. 33, the driver accessory 700 includes a locking mechanism configured as a detent 768 supported by the first housing portion 712, and two recesses 772, 774 defined on the ball 758 of the second housing portion 716. The detent 768 is positioned within an aperture 778 in the first housing portion 716. The detent 768 may be received in either of the recesses 772, 774 to secure the second housing portion 716 in the first and second pivotal positions mentioned above, respectively. Accordingly, when switching between the first and second pivotal positions, the detent 768 is permitted to move out of one of the recesses 772, 774 and into the other of the recesses 772, 774. The driver accessory 700 further includes an actuator (e.g., a sleeve 776) that is axially slidable along the first housing portion 712 against the bias of a spring 778. The sleeve 776 includes a detent recess 780 in an inner periphery of the sleeve 776 in which the detent 768 is selectively received. The sleeve 776 is movable between a locking position (FIG. 33), in which the detent 768 is misaligned with the detent recess 780 and therefore prevented from disengaging the particular recess 772, 774 in which it is received, and a release position, in which the detent 768 is aligned with the detent recess 780 to permit the detent 768 to disengage or move out of the recess 772, 774 to reposition the output shaft 22*h* relative to the input shaft 14*h*. Alternatively, the detent 768 may be supported by the second housing portion 716, and the recesses 772, 774 may be defined on an inner surface of the first housing portion 712. As a further alternative, the sleeve 776 may be rotatable between the locking position and the release position. Other structure and/or components may alternatively be employed to provide a positive stop between the first and second housing portions 712, 716 when pivoting the second housing portion 716 relative to the first housing portion 712.

In operation of the driver accessory 700, the input shaft 14*h* is secured to a chuck of a drill, or a socket of a hand driver, and a tool bit is inserted within the socket 30*h* of the output shaft 22*h*. The second housing portion 716 is then pivoted between the first and second pivotal positions to orient the output shaft 22*h* at a desired angle or position with respect to the input shaft 14*h*. For example, to orient the output shaft 22*h* at a substantially 30-degree angle with respect to the input shaft 14*h*, the sleeve 776 is refracted to its release position and the second housing portion 716 is pivoted to its second pivotal position, in which the detent 768 is received within the recess 774. Releasing the sleeve 776 then permits the sleeve 776 to return to its locking position to maintain the detent 768 within the recess 774. Likewise, to orient the output shaft 22*h* substantially coaxial with the input shaft 14*h*, the sleeve 776 is retracted to its release position and the second housing portion 716 is pivoted to its first pivotal position, in which the detent 768 is received within the recess 772. Releasing the sleeve 776 then permits the sleeve 776 to return to its locking position to maintain the detent 768 within the recess 772. The housing 708 supports the output shaft 22*h* relative to the input shaft 14*h* as torque from the input shaft 14*h* is transferred to the output shaft 22*h* via the joint 704, without any additional assistance from the operator of the drill and/or hand driver. As such, the operator may use their free hand to maintain the alignment of the fastener being driven into the workpiece during the initial period of insertion of the fastener into the workpiece.

Various features of the invention are set forth in the following claims.

What is claimed is:

1. A driver accessory comprising:

a housing including a first housing portion and a second housing portion movable relative to the first housing portion;

an input shaft at least partially received in the first housing portion and defining a first axis;

an output shaft at least partially received in the second housing portion and defining a second axis, the output shaft being supportable by the housing in a first position relative to the input shaft in which the first and second axes are substantially coaxial, and in a second position relative to the input shaft in which the first and second axes are not coaxial;

a detent supported by one of the first and second housing portions; and a plurality of recesses defined on the other of the first and second housing portions, wherein the detent is receivable in a first of the plurality of recesses to secure the output shaft in the first position, wherein the detent is receivable in a second of the plurality of recesses to secure the output shaft in the second position, and wherein the detent is movable from the first recess to the second recess in response to the output shaft being moved from the first position to the second position.

2. The driver accessory of claim 1, wherein the second housing portion is movable relative to the first housing portion to move the output shaft between the first and second positions.

3. The driver accessory of claim 2, wherein the second housing portion pivots relative to the first housing portion to move the output shaft between the first and second positions.

4. The driver accessory of claim 1, further comprising a joint coupling the input shaft and the output shaft.

5. The driver accessory of claim 4, wherein the joint is configured as a universal joint.

6. The driver accessory of claim 5, wherein the universal joint includes a pin carried by the output shaft, and a socket formed in the input shaft in which the pin is received, the socket configured to permit pivoting of the output shaft relative to the first axis.

7. The driver accessory of claim 4, wherein the joint is configured as a ball-and-socket joint.

8. The driver accessory of claim 7, wherein the ball-and-socket joint includes a ball carried by one of the input shaft and the output shaft, and a socket formed in the other of the input shaft and the output shaft in which the ball is received, the socket configured to permit pivoting of the output shaft relative to the first axis.

9. The driver accessory of claim 8, wherein the ball includes a hexagonal cross-sectional shape, and wherein the socket includes a corresponding hexagonal cross-sectional shape.

10. The driver accessory of claim 7, wherein one of the first housing portion and the second housing portion defines a ball and the other of the first housing portion and the second housing portion defines a socket sized to receive the ball to allow movement between the first housing portion and the second housing portion.

11. The driver accessory of claim 1, wherein the input shaft includes a shank having a hexagonal cross-sectional shape configured to be received within a chuck of a driver apparatus, and wherein the output shaft includes a socket having a hexagonal cross-sectional shape configured to receive a tool bit having a hexagonal drive end.

12. The driver accessory of claim 1, wherein one of the input shaft and the output shaft includes a ball and the other of the input shaft and the output shaft includes a socket sized to receive the ball, and wherein one of the first housing portion and the second housing portion defines a ball and the other of the first housing portion and the second housing portion defines a socket sized to receive the ball to allow movement between the first housing portion and the second housing portion.

13. The driver accessory of claim 1, further comprising a biasing member and an aperture defined in one of the first housing portion and the second housing portion sized to receive a portion of the biasing member, wherein the other of the first housing portion and the second housing portion includes the recesses.

14. The driver accessory of claim 13, wherein the aperture defines a first diameter and the ball defines a second diameter, the second diameter being smaller than the first diameter.

15. The driver accessory of claim 13, wherein the aperture defines an axis that is substantially parallel to the first axis.

16. The driver accessory of claim 15, further comprising a deflector positioned to deflect the detent such that the deflector and the biasing member cooperate such that the detent applies a force in a direction that is not parallel to the first axis.

17. The driver accessory of claim 1, wherein the second housing portion is rotatable about the second axis relative to the first housing portion to move the output shaft between the first position and the second position.

18. The driver accessory of claim 17, further comprising:

at least two intermediate shafts interconnecting the input and output shafts, and at least two additional housing portions in which the intermediate shafts are at least partially received, respectively, positioned between the first and second housing portions.

19. The driver accessory of claim 18, wherein the housing is manipulable between at least four different configurations to support the output shaft relative to the input shaft in at least four different orientations by rotating adjacent housing portions relative to each other.

* * * * *